US007250567B2

(12) United States Patent
Gayama

(10) Patent No.: US 7,250,567 B2
(45) Date of Patent: Jul. 31, 2007

(54) AUTOMATIC MUSICAL COMPOSITION CLASSIFICATION DEVICE AND METHOD

(75) Inventor: Shinichi Gayama, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 131 days.

(21) Appl. No.: 10/988,535

(22) Filed: Nov. 16, 2004

(65) Prior Publication Data

US 2005/0109194 A1 May 26, 2005

(30) Foreign Application Priority Data

Nov. 21, 2003 (JP) ..... 2003-392292

(51) Int. Cl.
*G10H 1/38* (2006.01)
*G10H 7/00* (2006.01)

(52) U.S. Cl. ..... 84/613; 84/609; 84/637; 84/649; 84/650; 84/669

(58) Field of Classification Search ..... None
See application file for complete search history.

(56) References Cited

U.S. PATENT DOCUMENTS 4,951,544 A * 8/1990 Minamitaka ..... 84/613
5,179,241 A * 1/1993 Okuda et al. ..... 84/613
5,451,709 A * 9/1995 Minamitaka ..... 84/609
5,510,572 A * 4/1996 Hayashi et al. ..... 84/609
2002/0112596 A1 8/2002 Kondo

FOREIGN PATENT DOCUMENTS

JP 2000-268541 9/2000
JP 2001-297093 10/2001
JP 2002-41059 2/2002
JP 2002-278547 9/2002
JP 2003-58147 2/2003
WO WO 02/01548 A1 1/2002

OTHER PUBLICATIONS

Mikihiko Terashima et al., "Unsupervised Cluster Segmentation Method Using Data Density Histogram on Self-Organizing Feature Map" IEEE Communications Magazine, D-11, vol. J79-D-11, No. 7, 1996.

T. Lambrou, et al.; Classification of Audio Signals Using Statistical Features on Time and Wavelet Transform Domains; Acoustics, Speech and Signal Processing; May 12, 1998; pp. 3621-3624.

Esbem Skovenborg, et al.; Extraction of Structural Patterns in Popular Melodies; CMMR, May 26, 2003, LINCS 2771, pp. 98-113.

* cited by examiner

*Primary Examiner*—Marlon T Fletcher
(74) *Attorney, Agent, or Firm*—Drinker Biddle & Reath LLP

(57) ABSTRACT

An automatic musical composition classification device and method that allow a plurality of musical compositions to be automatically classified based on the melody similarity. Chord progression pattern data representing a chord progression sequence for each of the plurality of musical compositions are saved, chord-progression variation characteristic amounts are extracted for each of the plurality of musical compositions in accordance with the chord progression pattern data, and the plurality of musical compositions are grouped in accordance with the chord progression sequence represented by the chord progression pattern data of each of the plurality of musical compositions and with the chord-progression variation characteristic amounts.

15 Claims, 27 Drawing Sheets

FIG. 3

| | |
|---|---|
| A | 1. 0 |
| A# | AX1. 059163 |
| B | AX1. 124622 |
| C | AX1. 189207 |
| C# | AX1. 259921 |
| D | AX1. 334840 |
| D# | AX1. 414214 |
| E | AX1. 498307 |
| F | AX1. 587401 |
| F# | AX1. 681793 |
| G | AX1. 781797 |
| G# | AX1. 887749 |
| A | AX2. 0 |

FIG. 5

A+C+E+G(Am7)
→ A+C+E(Am) | C+E+G(C)
A+C+E♭+F#(Adim7)
→ A+C+E♭(Adim7 CANDIDATE ) | C+E♭+F#(Cdim7 CANDIDATE )
A+C#+E+G(A7)
→ A+C#+E(A) | A+C#+G(A7 CANDIDATE ) | C#+E+G(C#dim7 CANDIDATE )
A+C+E+G+B(Am7. 9)
→ A+C+E(Am) | C+E+G(C) | E+G+B(Em)

FIG. 6

TIME (4 BYTES) FIRST CHORD CANDIDATES (1 BYTE)
SECOND CHORD CANDIDATES (1 BYTE)
TIME (4 BYTES) FIRST CHORD CANDIDATES (1 BYTE)
SECOND CHORD CANDIDATES (1 BYTE)

⋮

TIME (4 BYTES) FIRST CHORD CANDIDATES (1 BYTE)
SECOND CHORD CANDIDATES (1 BYTE)

FIG. 7A

| FUNDAMENTAL TONE | |
|---|---|
| A | 0 × 00 |
| A# | 0 × 01 |
| B | 0 × 02 |
| C | 0 × 03 |
| C# | 0 × 04 |
| D | 0 × 05 |
| D# | 0 × 06 |
| E | 0 × 07 |
| F | 0 × 08 |
| F# | 0 × 09 |
| G | 0 × 0A |
| G# | 0 × 0B |

FIG. 7B

| ATTRIBUTE | |
|---|---|
| MAJOR | 0 × 00 |
| MINOR | 0 × 02 |
| SEVEN CANDIDATE | 0 × 01 |
| Dim7 CANDIDATE | 0 × 03 |

FIG. 7C

ATTRIBUTE (LOWER $ BITS ) + FUNDAMENTAL TONE (LOWER 4 BITS)

FIG. 14

MUSIC IDENTIFICATION INFORMATION (OTHER THAN FILE NAME)

[CHORD VARIATION M] [TRANSITION TIME T(0)] [CHORD0 × 08], [TRANSITION TIME T(1)]
[CHORD0 × 0A] [T(2)] [0 × 05] [T(3)] [0 × 01] [T(4)] [0 × 28] · · · · · · · · · · ·

AUTOMATIC MUSICAL COMPOSITION CLASSIFICATION DEVICE AND METHOD

BACKGROUND OF THE INVENTION

1. Field of the Invention

The present invention relates to an automatic musical composition classification device and method for automatically classifying a plurality of musical compositions.

2. Description of the Related Art

Due to the popularization of compressed musical data and the increased capacities of storage devices in recent years, individuals have also been able to store and enjoy large amounts of music. On the other hand, it has become extremely difficult for users to sort large quantities of musical compositions and find the musical composition that they would like to listen to. There is therefore a need for an effective musical composition classification and selection method to resolve this problem.

Conventional musical composition classification methods include methods that use information appearing in a bibliography such as the song title, singer, the name of the genre to which the music belongs such as rock or popular music, and the tempo in order to classify musical compositions stored in large quantities as specific kinds of music, as disclosed in Japanese Patent Kokai No. 2001-297093.

Methods also include a method used in classification and selection that allocates a word or expression such as 'uplifting' that can be shared between a multiplicity of subjects who listen to the music for characteristic amounts such as beat and frequency fluctuations that are extracted from a musical composition signal, as disclosed by Japanese Patent Kokai No. 2002-278547.

Furthermore, a method has been proposed that extracts three musical elements (melody, rhythm, and harmony) from part of a musical composition signal such as rock or 'enka' (modern Japanese ballad) and associates these three elements with a genre identifier such that, when a source of music with a mix of genres and the name of the object genre are subsequently provided, only the music source matching the genre name is recorded in a separate device, as disclosed by Japanese Patent Application Laid Open No. 2000-268541.

Further, a known conventional musical composition classification method performs automatic classification in the form of a matrix by using, as musical characteristic amounts, the tempo, major or minor keys, and soprano and base levels, and then facilitates selection of the musical composition, as disclosed by Japanese Patent Kokai No. 2003-58147.

There are also methods that extract acoustic parameters (cepstrum and power higher order moments) of music that has been selected once by the user and then subsequently present music with similar acoustic parameters, as disclosed by Japanese Patent Kokai No. 2002-41059.

However, the method of using information displayed in a bibliography such as the song title, genre, and so forth illustrated in Japanese Patent Kokai No. 2001-297093 has been confronted by problems, i.e. this method requires work on the part of the individual, does not permit a network connection, and does not function at all when information for classification is hard to obtain. For example, this method does not function at all when information for classification is hard to obtain.

In the case of the classification method of Japanese Patent Kokai No. 2002-278547, a listener's image of the music is subjective and, because this image is vague and varies even for the same listener, continuous results cannot be expected when classification is performed using an image other than that of the party concerned. Therefore, in order to retain the effect of subjective image language, continuous feedback from the listener for the classification operation is required, which makes for problems such as that of forcing a labor-intensive operation on the listener. There is also the problem that the classification of beat or other rhythm information is limited by the target music.

According to the classification method of Japanese Patent Kokai No. 2000-268541, classification takes place by using at least one of three musical elements extracted from the musical composition signal. However, the specific association between each characteristic amount and genre identifier is difficult based on the disclosed technology. Further, it is hard to consider a large classification key for determining the genre in classification that uses only a few bars' worth of the three musical elements.

The proposed combination of the tempo and tonality, and so forth, of the classification method of Japanese Patent Kokai No. 2003-58147 allows the clarity and pace of the music to be implemented fundamentally and is desirable in order to express the melody. The words "melody" and "melodies" that we referred here and hereafter do not represent specific elements like vocal or instrumental parts of music. Rather these words are intended to represent a rough tune of music, like similarities of accompaniments or arrangements of music. In the classification method described above, there is however a problem that the tempo, tonality and so forth of the actual musical composition have very little consistency and accuracy is low for characteristic amounts that allow classification to be performed in musical composition units.

Further, with the methods of Japanese Patent Kokai Nos. 2001-297093, 2002-278547, 2000-268541, and 2003-58147, music selections are made by using statically defined language such as image words, genre names, and major and minor keys, and because the impression of the musical composition varies depending on the mood, there is the problem that the appropriate music composition selection cannot be made.

Although Japanese Patent Kokai No. 2002-41059 describes the fact that musical compositions matched to the listener's preferences are provided as musical compositions are selected, because the characteristic amounts that are actually used are rendered by converting results extracted from all or part of the music signal into numerical values, variations in the melody in the musical composition cannot be expressed. The problem therefore exists that the precision that is appropriate for classifying musical compositions based on preferences cannot be secured.

SUMMARY OF THE INVENTION

The above drawback is cited as an example of the problems that the present invention is to resolve, and an object of the present invention is to provide an automatic musical composition classification device and method that make it possible to automatically classify a plurality of musical compositions based on melody similarity.

The automatic musical composition classification device according to a first aspect of the present invention is an automatic musical composition classification device that automatically classifies a plurality of musical compositions, comprising a chord progression data storage part that saves chord progression pattern data representing a chord progression sequence for each of the plurality of musical compositions; a characteristic amount extraction part that extracts chord-progression variation characteristic amounts for each of the plurality of musical compositions in accordance with the chord progression pattern data; and a cluster creation part that groups the plurality of musical compositions in accordance with the chord progression sequence represented by the chord progression pattern data of each of the plurality of musical compositions and with the chord-progression variation characteristic amounts.

The automatic musical composition classification method according to the present invention is a method for automatically classifying musical compositions that automatically classifies a plurality of musical compositions, comprising the steps of storing chord progression pattern data representing a chord progression sequence for each of the plurality of musical compositions; extracting a chord-progression variation characteristic amount for each of the plurality of musical compositions in accordance with the chord progression pattern data; and grouping the plurality of musical compositions in accordance with the chord progression sequence represented by the chord progression pattern data of each of the plurality of musical compositions and with the chord-progression variation characteristic amounts.

A program according to another aspect of the present invention is a computer-readable program that executes an automatic musical composition classification method that automatically classifies a plurality of musical compositions, comprising a chord progression data storage step that saves chord progression pattern data representing a chord progression sequence for each of the plurality of musical compositions; a characteristic amount extraction step of extracting a chord-progression variation characteristic amount for each of the plurality of musical compositions in accordance with the chord progression pattern data; and a cluster creation step that groups the plurality of musical compositions in accordance with the chord progression sequence represented by the chord progression pattern data for each of the plurality of musical compositions and with the chord-progression variation characteristic amounts.

BRIEF DESCRIPTION OF THE DRAWINGS

FIG. 3 shows frequency ratios of each of twelve tones and the tone of a superoctave A in a case where the tone of A is 1.0;

FIG. 5 shows conversions from chords consisting of four tones to chords consisting of three tones;

FIG. 6 shows the recording format;

FIGS. 7A to 7C shows a method of representing fundamental tones and chord attributes and a method of representing chord candidates;

FIG. 14 shows the format when the chord progression variation characteristic amounts are saved:

DETAILED DESCRIPTION OF THE INVENTION

The embodiment of the present invention will be described in detail below with reference to the drawings.

Figure 1:
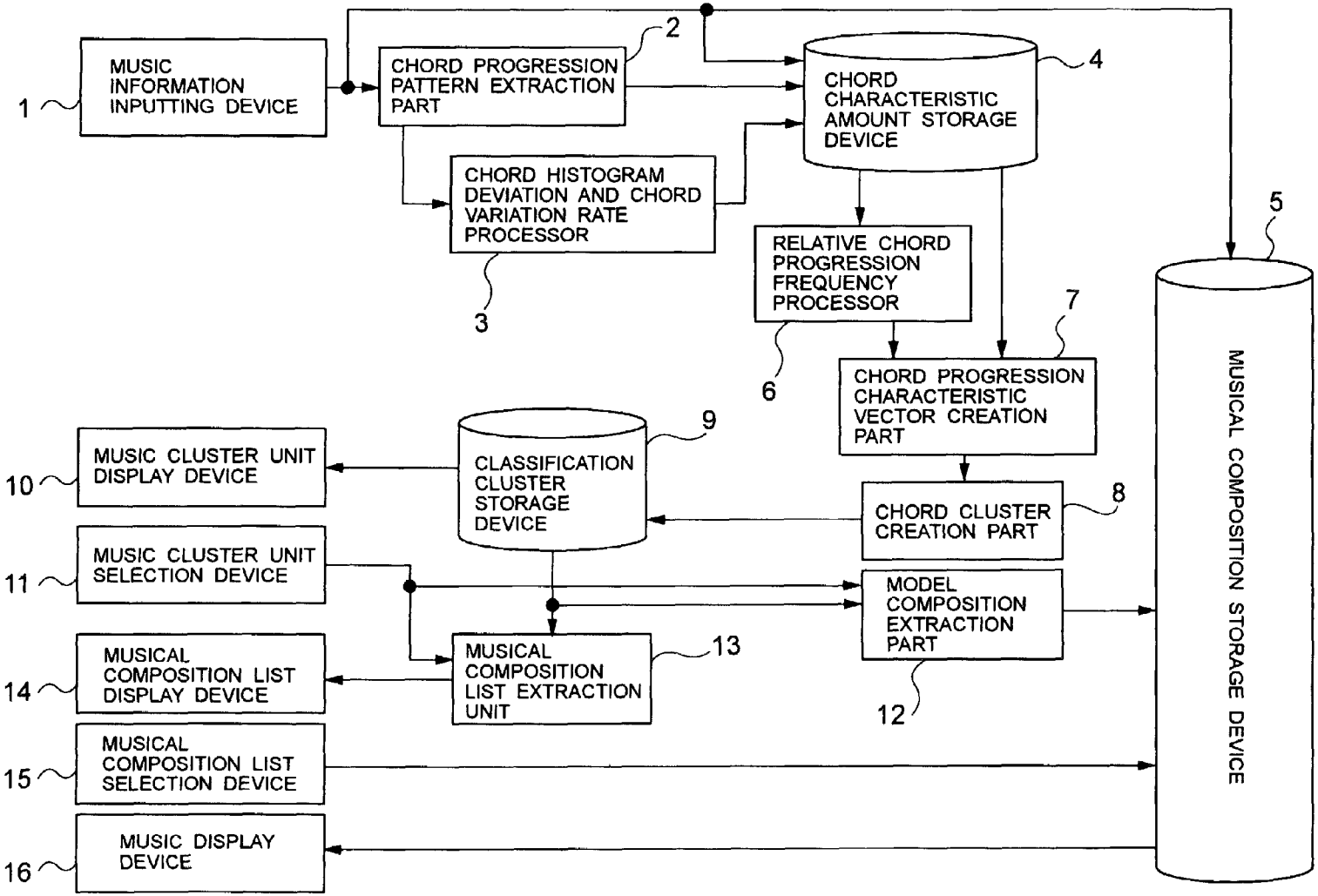
FIG. 1 is a block diagram showing an embodiment of the present invention.

FIG. 1 shows the automatic musical composition classification device according to the present invention. The automatic musical composition classification device comprises a music information inputting device 1, a chord progression pattern extraction part 2, a chord histogram deviation and chord variation rate processor 3, a chord characteristic amount storage device 4, a musical composition storage device 5, a relative chord progression frequency processor 6, a chord progression characteristic vector creation part 7, a music cluster creation part 8, a classification cluster storage device 9, a music cluster unit display device 10, a music cluster selection device 11, a model composition extraction part 12, a musical composition list extraction part 13, a musical composition list display device 14, a musical composition list selection device 15, and a music playback device 16.

The music information inputting device 1 pre-inputs, as music sound data, digital musical composition signals (audio signals) of a plurality of musical compositions that are to be classified, and inputs playback musical composition signals from a CD-ROM drive, CD player, or the like or signals rendered by decoding compressed musical composition sound data, for example. Because a musical composition signal can be inputted, musical composition data may be rendered by digitizing an audio signal of an analog recording for which an external input or the like is employed. Further, musical composition identification information may be inputted together with the musical composition sound data. Musical composition identification information may include, for example, the song title, the singer's name, the name of the genre, and a file name. However, information that is capable of specifying a musical composition by means of a single item or a plurality of types of items is acceptable.

The output of the music information inputting device 1 is connected to the chord progression pattern extraction part 2, the chord characteristic amount storage device 4 and the musical composition storage device 5.

The chord progression pattern extraction part 2 extracts chord data from a music signal that has been inputted via the music information inputting device 1 and thus generates a chord progression sequence (chord progression pattern) for the musical composition.

The chord histogram deviation and chord variation rate processor 3 generates a histogram from the types of chord used and the frequency thereof in accordance with the chord progression pattern generated by the chord progression pattern extraction part 2 and then computes the deviation as the degree of variation of the melody. The chord histogram deviation and chord variation rate processor 3 also computes the per-minute chord variation rate, which is used in the classification of the music tempo.

The chord characteristic amount storage device 4 saves the chord progression that is obtained by the chord progression pattern extraction part 2 for each musical composition, the chord histogram deviation and chord variation rate that are obtained by the pattern chord histogram deviation and chord variation rate processor 3, and the musical composition identification information that is obtained by the music information inputting device 1 as the chord progression variation characteristic amounts. During this saving process, the musical composition identification information is used as identification information that makes it possible to identify each of a plurality of musical compositions that have been classified.

The musical composition storage device 5 associates and saves the musical composition sound data and musical composition identification information that have been inputted by the music information inputting device 1.

The relative chord progression frequency processor 6 computes the frequency of the chord progression pattern that is common to musical compositions whose musical composition sound data has been stored in the musical composition storage device 5 and then extracts the characteristic chord progression pattern used in the classification.

The chord progression characteristic vector creation part 7 generates, as a multidimensional vector, a ratio that includes a characteristic chord progression pattern rendered as a result of a plurality of musical compositions to the classified being processed by the relative chord progression frequency processor 6.

The musical composition cluster creation part 8 creates a cluster of similar musical compositions in accordance with a chord progression characteristic vector of a plurality of musical compositions for classification that is generated by the chord progression characteristic vector creation part 7.

The classification cluster storage device 9 associates and saves clusters that are generated by the musical composition cluster creation part 8 and musical composition identification information corresponding with the musical compositions belonging to the clusters. The music cluster unit display device 10 displays each of the musical composition clusters stored in the classification cluster storage device 9 in order of melody similarity and so that the quantity of musical compositions that belong to the musical composition cluster is clear.

The music cluster selection device 11 is for selecting a music cluster that is displayed by the music cluster unit display device 10. The model composition extraction part 12 extracts the musical composition containing the most characteristics of the cluster from among the musical compositions belonging to the cluster selected by the music cluster selection device 11.

The musical composition list extraction part 13 extracts musical composition identification information on each musical composition belonging to the cluster selected by the music cluster selection device 11 from the classification cluster storage device 9. The musical composition list display device 14 displays the content of the musical composition identification information extracted by the musical composition list extraction part 13 as a list.

The musical composition list selection device 15 selects any musical composition from within the musical composition list displayed by the musical composition list display device 14 in accordance with a user operation. The music playback device 16 selects the actual musical composition sound data from the musical composition storage device 5 and plays back this sound data as an acoustic output in accordance with the musical composition identification information for the musical composition that has been extracted or selected by the model composition extraction part 12 or musical composition list selection device 15 respectively.

The automatic musical composition classification device of the present invention with this constitution performs chord characteristic amount extraction processing. The chord characteristic amount extraction processing is processing in which, for a plurality of musical compositions targeted for classification, musical composition sound data and musical composition identification information that are inputted via the music information inputting device 1 are saved in the musical composition storage device 5 and, at the same time, the chord-progression variation characteristic amounts in the musical composition sound represented by the musical composition sound data are extracted as data and then saved in the chord characteristic amount storage device 4.

When the chord characteristic amount extraction processing is described specifically, let us suppose that the quantity of musical compositions to be processed is Q and the counter value for counting the quantity of musical compositions is N. At the start of the chord progression characteristic amount extraction processing, the counter value N is preset at 0.

Figure 2:
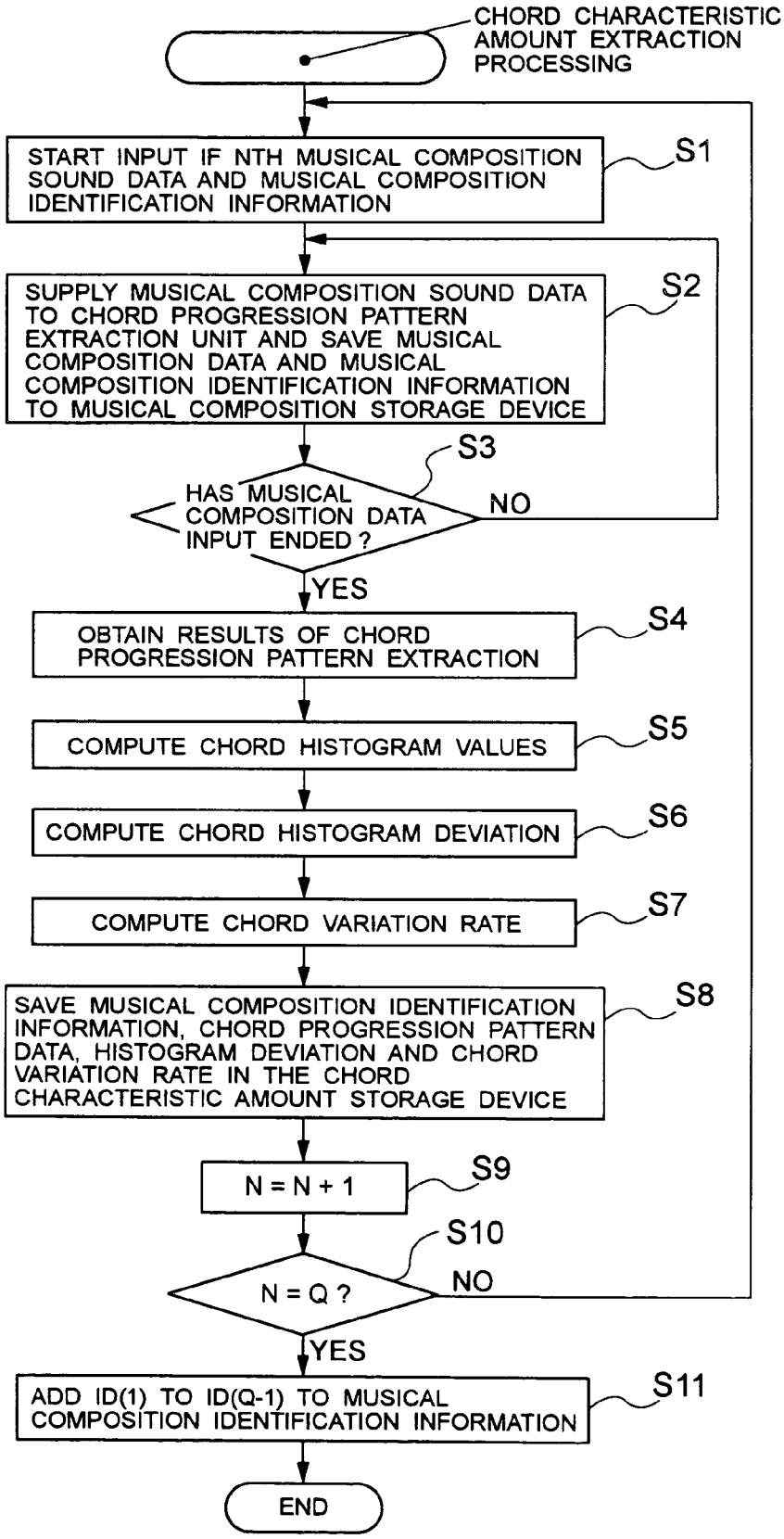
FIG. 2 is a flowchart showing chord characteristic amount extraction processing.

In the chord characteristic amount extraction processing, as shown in FIG. 2, the inputting via the music information inputting device 1 of Nth music data and musical composition identification information is first started (step S1). Thereafter, the Nth music data is supplied to the chord progression pattern extraction part 2 and the Nth musical composition sound data and musical composition identification information are associated and saved in the musical composition storage device 5 (step S2). The saving of the Nth music data of step S2 is continued until it is judged in the next step S3 that the inputting of the Nth music data has ended.

If the inputting of the Nth music data has ended, the chord progression pattern extraction results are obtained from the chord progression pattern extraction part 2 (step S4).

Here, chords are extracted for twelve tones of an equally-tempered scale corresponding with five octaves. The twelve tones of the equally-tempered scale are A, A#, B, C, C#, D, D#, E, F, F#, G, and G#. FIG. 3 shows frequency ratios for each of the twelve tones and a superoctave tone A in a case where the tone of A is 1.0.

Figure 4:
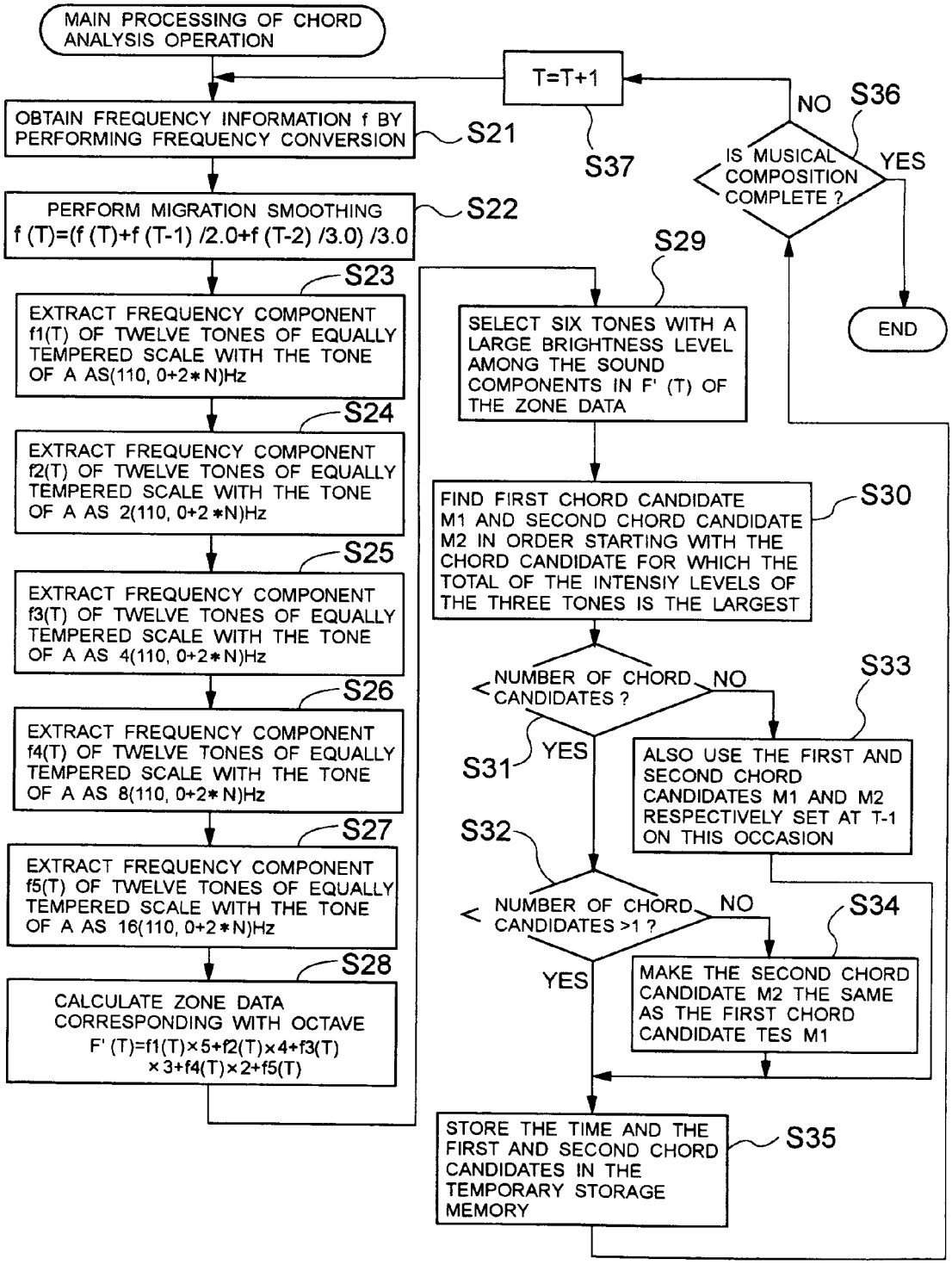
FIG. 4 is a flowchart showing the main processing of a chord analysis operation.

In the chord progression pattern extraction processing of the chord progression pattern extraction part 2, frequency information f (T) is obtained by performing frequency conversion on a digital input signal at 0.2 second intervals by means of a Fourier Transform (step S21), as shown in FIG. 4. Further, migration averaging is performed by using the current f(T), the previous f(T−1) and f(T−2) that precedes f(T−1) (step S22). In this migration averaging, frequency information for the two previous occasions is employed based on the assumption that there is very little variation in a chord within a 0.6 second interval. The migration averaging is computed by means of the following equation:

$$f(T)=(f(T)+f(T-1)/2.0+f(T-2)/3.0)/3.0 \quad (1)$$

Following the execution of step S22, frequency components f1(T) to f5(T) are each extracted from frequency information that has undergone migration averaging f(T) (steps S23 to S27). As per steps S6 to S10 above, the frequency components f1(T) to f5(T) are twelve tones A, A#, B, C, C#, D, D#, E, F, F#, G, and G# of the equally-tempered scale that correspond with five octaves of which the fundamental frequency is (110.0+2×N) Hz. For f1(T) of step S23, the tone of A is (110.0+2×N) Hz, for f2(T) of step S24, the tone of A is 2×(110.0+2×N) Hz, for f3(T) of step S25, the tone of A is 4×(110.0+2×N) Hz, for f4(T) of step S26, the tone of A is 8×(110.0+2×N) Hz, and for f5(T) of step S27, the tone of A is 16×(110.0+2×N) Hz. Here, N is the differential value for the frequency of the equally-tempered scale and is set to a value between −3 and 3, but may be 0 if same can be ignored.

Following the execution of steps S23 to S27, the frequency components f1(T) to f5(T) are converted to one octave's worth of zone data F'(T) (step S28). The zone data F'(T) may be expressed as:

$$F'(T)=f1(T)\times 5+f2(T)\times 4+f3(T)\times 3+f4(T)\times 2+f5(T) \quad (2).$$

That is, after each of the frequency components f1(T) to f5(T) have been individually weighted, same are added together. The zone data F'(T) then contains each sound component.

Following the execution of step S28, the intensity level in each sound component in the zone data F'(T) is large and therefore six tones are selected as candidates (step S29), and two chords M1 and M2 are created from these six sound candidates (step S30). A chord consisting of three tones is created with one of the six candidate tones serving as the root of the chord. That is, chords of 6C3 different combinations may be considered. The levels of the three tones making up each chord are added, and the chord for which the value resulting from this addition is the largest is the first chord candidate M1, while the chord for which the value resulting from this addition is the second largest is the second chord candidate M2.

The tones making up the chords are not limited to three. Four tones, as in the case of a seventh or diminished seventh, are also possible. Chords consisting of four tones may be classified as two or more chords consisting of three tones as shown in FIG. 5. Accordingly, just as chords consisting of four tones may be chords consisting of three tones, two chord candidates can be set in accordance with the intensity level of each sound component of the zone data F'(T).

Following the execution of step S30, it is judged whether the number of chord candidates set in step S30 exists (step S31). Because no chord candidates are set in cases where there is no difference in the intensity level rendered by only selecting at least three tones in step S30, the judgment of step S31 is executed. In cases where the number of chord candidates >0, it is also judged whether the number of chord candidates is greater than 1 (step S32).

In cases where it is judged in step S31 that the number of chord candidates=0, the chord candidates M1 and M2 set in the T−1 (approximately 0.2 seconds before) main processing are set as the current chord candidates M1 and M2 (step S33). In cases where it is judged in step S32 that the number of chord candidates=1, only the first chord candidate M1 is set in the current execution of step S30. Therefore, the second chord candidate M2 is set as the same chord as the first chord candidate M1 (step S34).

When it is judged in step S32 that the number of chord candidates >1, both the first chord candidate M1 and the second chord candidate M2 are set in the current execution of step S30 and the time and the first and second chord candidates M1 and M2 respectively are then stored in memory (not illustrated) within chord progression pattern extraction part 2 (step S35). The time and the first and second chord candidates M1 and M2 respectively are stored to memory as one set. The time is the number of times the main processing is executed, which is expressed as T which increases every 0.2 second. The first and second chord candidates M1 and M2 respectively are stored in the order of T.

More specifically, a combination of fundamental tones and attributes may be used to store each of the chord candidates to memory by means of one byte as shown in FIG. 6. Twelve tones of an equally-tempered scale are used as the fundamental tones, and the types of chords of major {3,4}, minor {3,4}, seventh candidates {4,6} and diminished sevenths (dim7) candidates {3,3} may be used for the attributes. The figures in { } represent the difference in the three tones when a half tone is 1. Originally, the seventh candidate is {4,3,3} and the diminished seventh (dim7) candidate is {3,3,3}. However, this is displayed as above for representation using three tones.

The twelve fundamental tones are rendered by means of sixteen bits (hexadecimal form) as shown in FIG. 7A, and the attribute chord types are rendered by means of sixteen bits (hexadecimal form) as shown in FIG. 7B. The lower four bits of the fundamental tones and the lower four bits of the attributes are linked in that order and used as chord candidates of 8 bits (one byte) as shown in FIG. 7C.

When step S33 or S34 is executed, step S35 is executed immediately afterward.

Following the execution of step S35, it is judged whether the musical composition has ended (step S36). For example, when there is no input of an analog audio input signal or in the event of an operation input indicating the end of the musical composition from the operation input device 4, it is judged that the musical composition has ended.

A value 1 is added to the variable T until it is judged that the musical composition has ended (step S37), and step S21 is executed once again. Step S21 is executed at 0.2 second intervals as mentioned earlier and is executed once again when 0.2 second have elapsed from the time of the previous execution.

Figure 8:
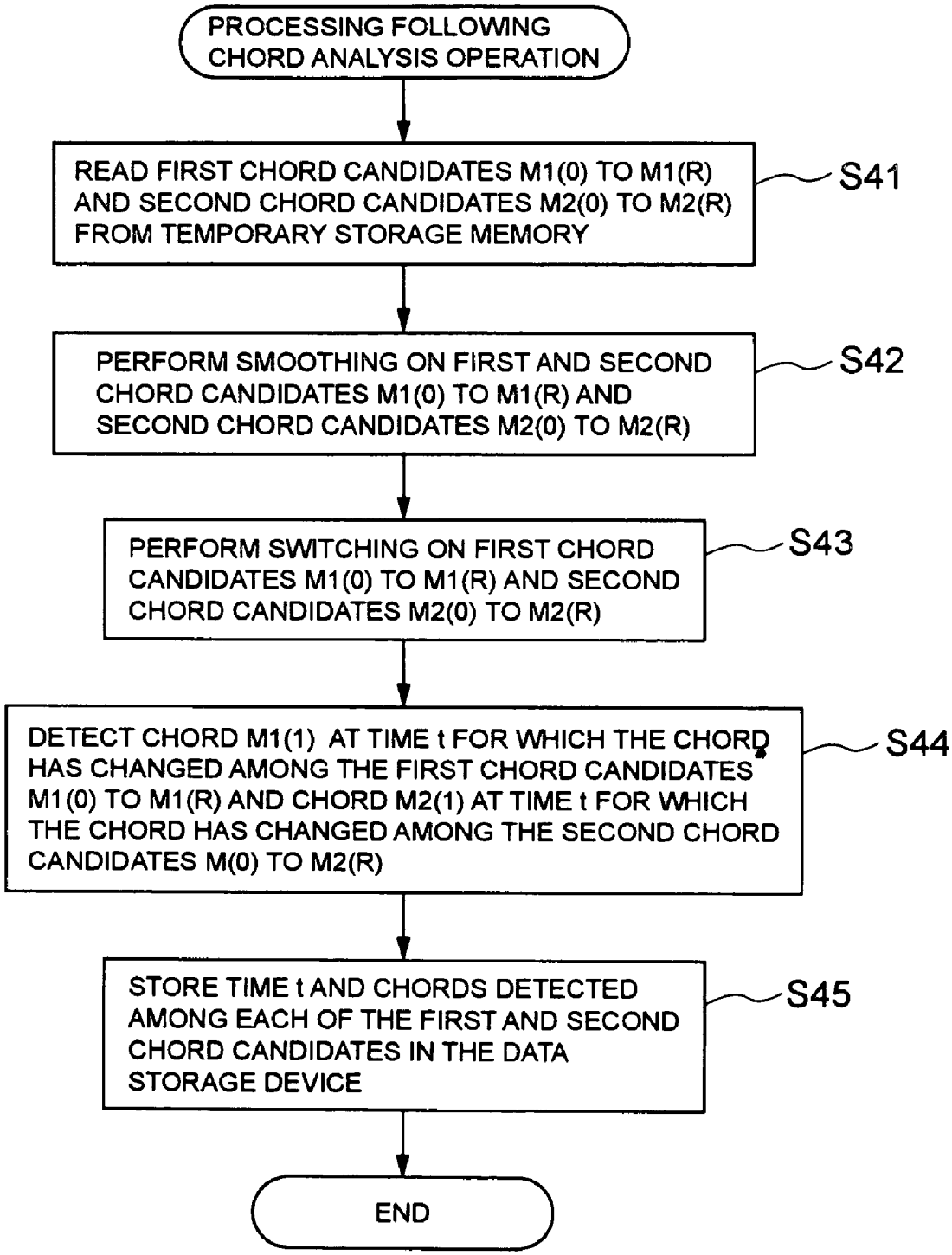
FIG. 8 is a flowchart showing processing following the chord analysis operation.

As shown in FIG. 8, after it is judged that the musical composition has ended, all of the first and second chord candidates are read from memory as M1(0) to M1(R) and M2(0) to M2(R) (step S41). 0 is the start time, and hence the first and second chord candidates at start time are M1(0) and M2(0) respectively. R is the end time, and hence the first and second chord candidates at the end time are M1(R) and M2(R) respectively. Smoothing is then performed on the first chord candidates M1(0) to M1(R) and second chord candidates M2(0) to M2(R) thus read (step S42). The smoothing is executed in order to remove any errors caused by noise contained in the chord candidates as a result of detecting the chord candidates at 0.2 second intervals irrespective of the chord variation time. As for the specific smoothing method, it is judged whether the relations M1(t−1)≠M1(t) and M1(t)≠M1(t+1) are satisfied for three consecutive first chord candidates M1(t−1), M1(t), and M1(t+1). In cases where the relations are satisfied, M1(t) is equalized with M1(t+1). The judgment is performed for each of the first chord candidates. Smoothing is performed on the second chord candidates by means of the same method. Further, M1(t+1) may be made equal to M1(t) instead of making M1(t) equal to M1(t+1).

After smoothing has been executed, processing to switch the first and second chord candidates is performed (step S43). Generally, the possibility of the chord changing in a short interval such as 0.6 second is low. However, sometimes switching of the first and second chord candidates takes place within 0.6 second due to fluctuations in the frequency of each sound component in the zone data F'(T) resulting from the signal-input stage frequency characteristic and from noise during a signal input. Step S43 is performed in order to counter this switching. As for the specific method of switching the first and second chord candidates, a judgment (as described subsequently) is performed for five consecutive first chord candidates M1(t−2), M1(t−1), M1(t), M1(t+1), and M1(t+2), and five consecutive second chord candidates M2(t−2), M2(t−1), M2(t), M2(t+1), and M2(t+2) that correspond with the first chord candidates. That is, it is judged whether the relations M1(t−2)=M1(t+2), M2(t−2)=M2(t+2), M1(t−1)=M1(t)=M1(t+1)=M2(t−2) and M2(t−1)=M2(t)=M2(t+1)=M1(t−2) are satisfied. When the relations are satisfied, it is established that M1(t−1)=M1(t)=M1(t+1)=M1(t−2) and M2(t−1)=M2(t)=M2(t+1)=M2(t−2), and chord switching between M1(t−2) and M2(t−2) is implemented. Further, chord switching between M1(t+2) and M2(t+2) may be performed instead of chord switching between M1(t−2) and M2(t−2). It is also judged whether the relations M1(t−2)=M1(t+1), M2(t−2)=M2(t+1), M1(t−1)=M1(t)=M1(t+1)=M2(t−2) and M2(t−1)=M2(t)=M2(t+1)=M1(t−2) are satisfied. If these relations are satisfied, it is established that M1(t−1)=M1(t)=M1(t−2) and M2(t−1)=M2(t)=M2(t−2) and chord switching is performed between M1(t−2) and M2(t−2). Further, chord switching may also be performed between M1(t+1) and M2(t+1) instead of chord switching between M1(t−2) and M2(t−2).

Figure 9:
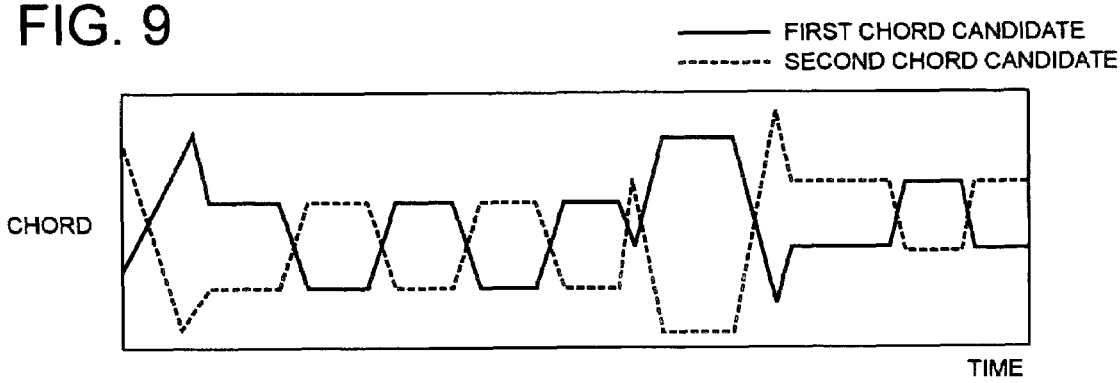
FIG. 9 shows the temporal variation of first and second chord candidates prior to smoothing.
Figure 10:
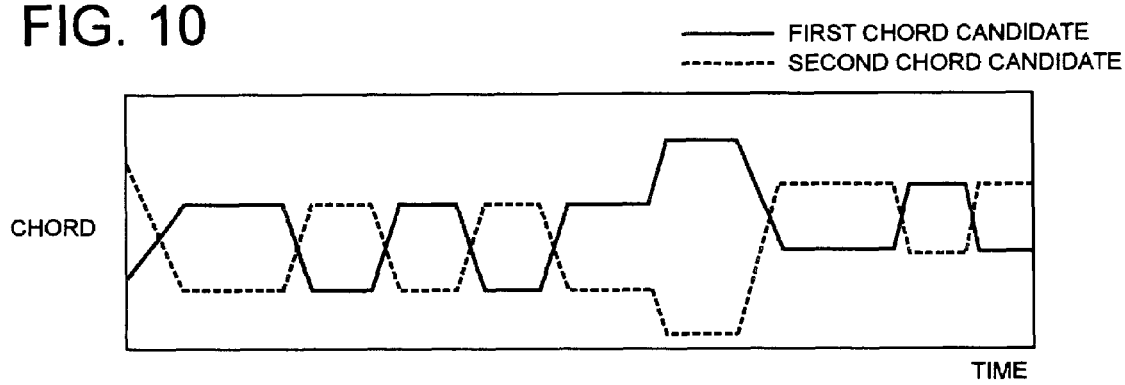
FIG. 10 shows the temporal variation of first and second chord candidates after smoothing.
Figure 11:
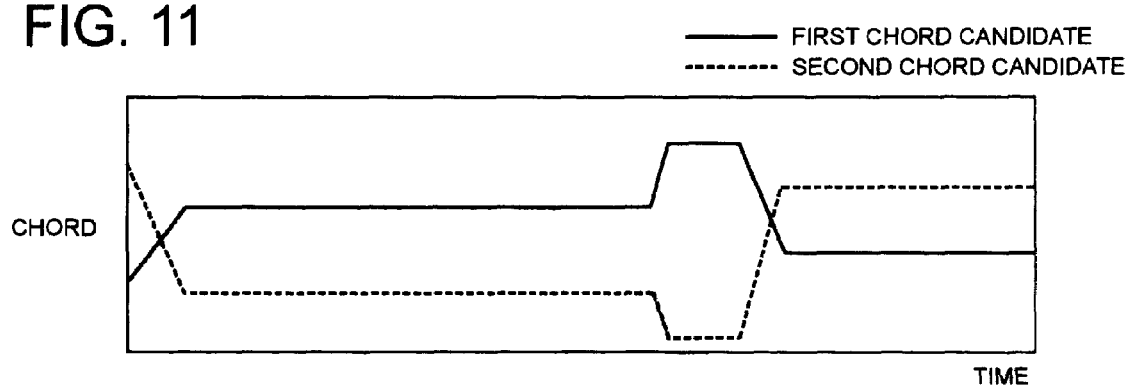
FIG. 11 shows the temporal variation of first and second chord candidates after switching.

When each of the chords of the first chord candidates M1(0) to M1(R) and second chord candidates M2(0) to M2(R) that are read in step S41 vary as time elapses as shown in FIG. 9, for example, the chords are corrected as shown in FIG. 10 by performing the averaging of step S42. In addition, the chord variation of the first and second chord candidates is corrected as shown in FIG. 11 by performing the chord switching of step S43. FIGS. 9 to 11 show the variation of the chord with time as a line graph in which positions corresponding chord types are plotted on the vertical axis.

M1(t) at time t at which a chord among the first chord candidates M1(0) to M1(R) that have undergone the chord switching of step S43 is detected (step S44), and the total number of chord variations M of the first chord candidates thus detected and the continuous chord time (four bytes) constituting the difference from the change time t and chords (four bytes) are outputted (step S45). One musical composition's worth of data, which is outputted in step S45, is chord progression pattern data.

Figures 12A, 12B, 12C, 12D:
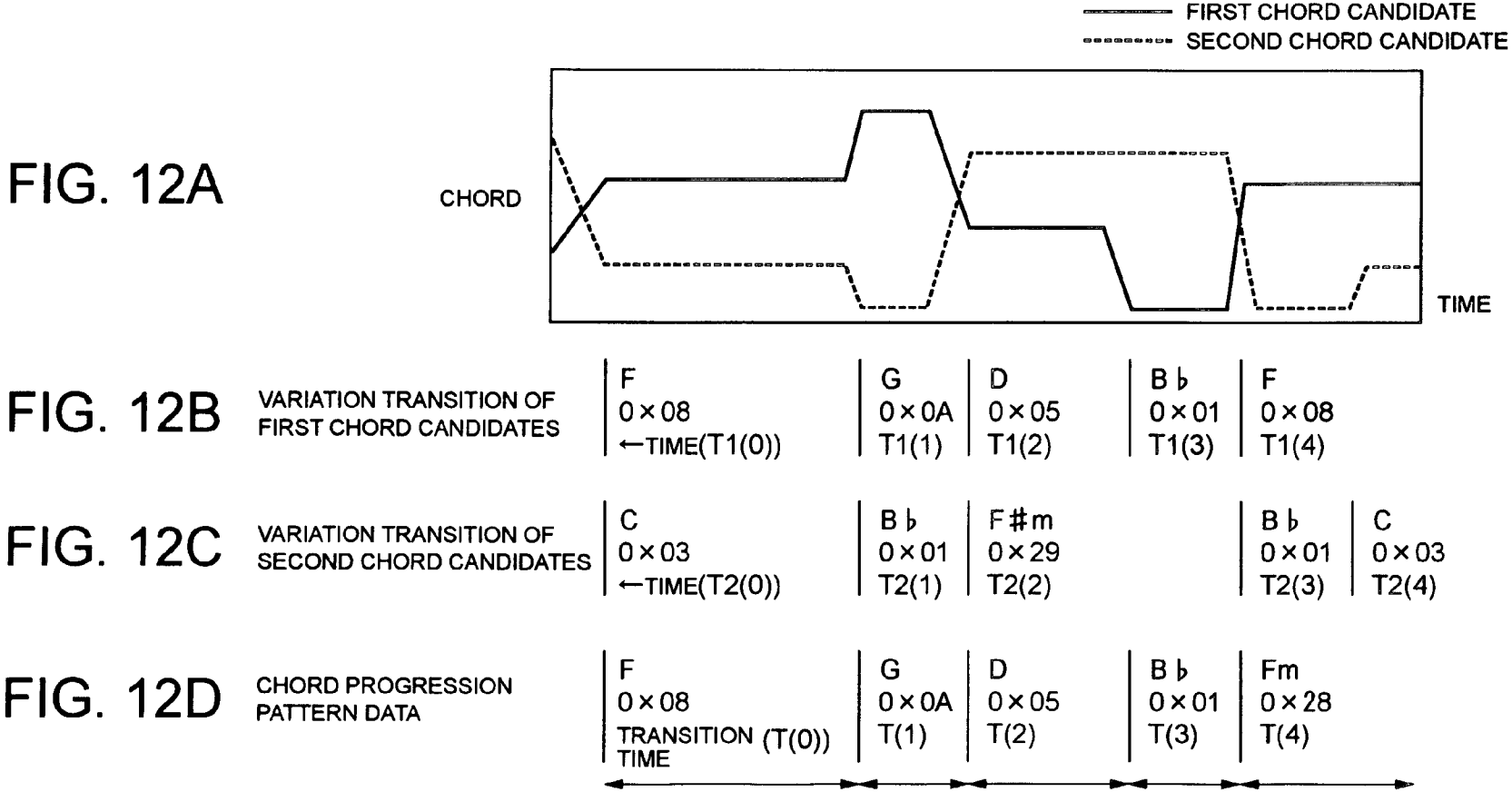
FIGS. 12A to 12D show a method of creating chord progression pattern data and the format of this data.

In cases where the chords of the first chord candidates M1(0) to M1(R) and the second chord candidates M2(0) to M2(R) following the chord switching of step S43 vary as time elapses as shown in FIG. 12A, the time of a variation time and the chord are extracted as data. FIG. 12B represents the data content at the time of the variation in the first chord candidates and F, G, D, B-flat, and F are the chords, which are expressed in as hexadecimal data by 0x08, 0x0A, 0x05, 0x01, and 0x08. The times of variation time t are T1(0), T1(1), T1(2), T1(3), and T1(4). Further, FIG. 12C represents the data content of the variation time of the second chord candidates and C, B-flat, F#m, B-flat, and C are chords, which are expressed as hexadecimal data as 0x03, 0x01, 0x29, 0x01, and 0x03. The times of variation time t are T2(0), T2(1), T2(2), T2(3), and T2(4). The data content shown in FIGS. 12B and 12C is outputted together with the musical composition identification information as chord progression pattern data in the format shown in FIG. 12D in step S45. The continuous chord times of the outputted chord progression pattern data are T(0)=T1(1)−T1(0) and T(1)=T1(2)−T1(1), and so forth.

Continuous times are added to each of the major, minor, and diminished chords A to G# the roots of which are the twelve tones of the chord progression pattern data extracted in step S4, and the histogram values are calculated by normalizing the maximum value so that same is 100 (step S5).

The histogram values may be calculated by means of the following equations (3) and (4), $$h'(i+k\times 12)=\Sigma T'(j) \tag{3}$$

$$h(i+k\times 12)=h'(i+k\times 12)\times 100/\max(h'(i+k\times 12)) \tag{4}$$

In these equations (3) and (4), i corresponds to the roots (twelve tones) of chords A to G#, such that i=0 to 11 respectively in that order. k corresponds to a major (k=0), minor(k=1) and diminished (k=2) chord respectively. J is the order of the chords, and a Σ calculation is performed for j=0 to M−1. h'(i+k×12) in equation (3) is the total time of the actual continuous chord time T'(j), and is h'(0) to h'(35). h(i+k×12) in equation (4) is the histogram value and is obtained as h(0) to h(35). The continuous chord time T(j) is T'(j) when the root of the jth chord of the chord progression pattern data is i, and the attribute is k. For example, if the 0th chord is a major C chord, because i=3 and k=0, the 0th continuous chord time T(0) is added to h'(3). That is, the continuous chord time T(j) is added as T'(j) to each chord with the same root and attribute, and the result is h'(i+k×12). max(h'(i+k×12)) is h'(i+k×12), that is, the maximum value among h'(0) to h'(35).

Figure 13A:
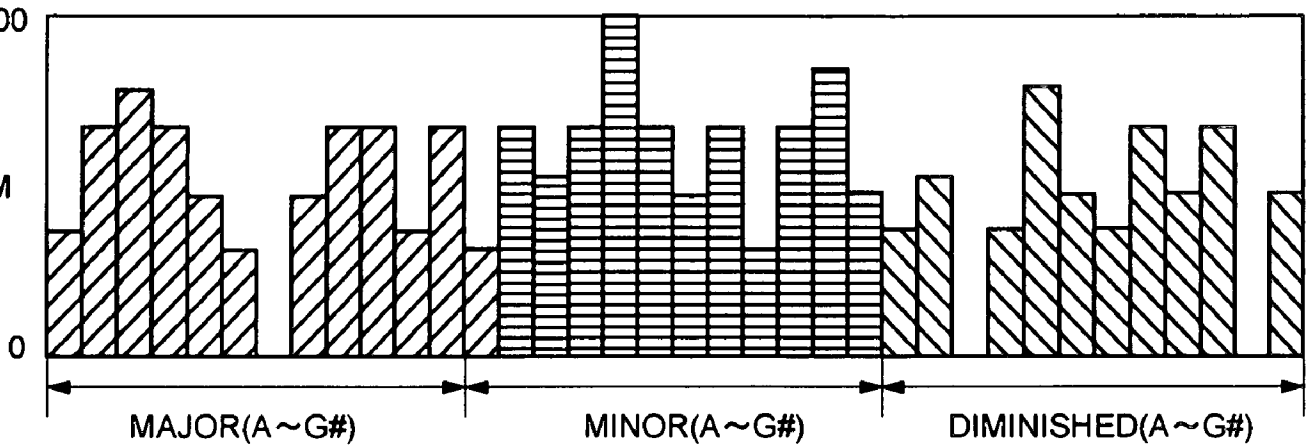
FIGS. 13A and 13B show histograms of chords in a musical composition.
Figure 13B:
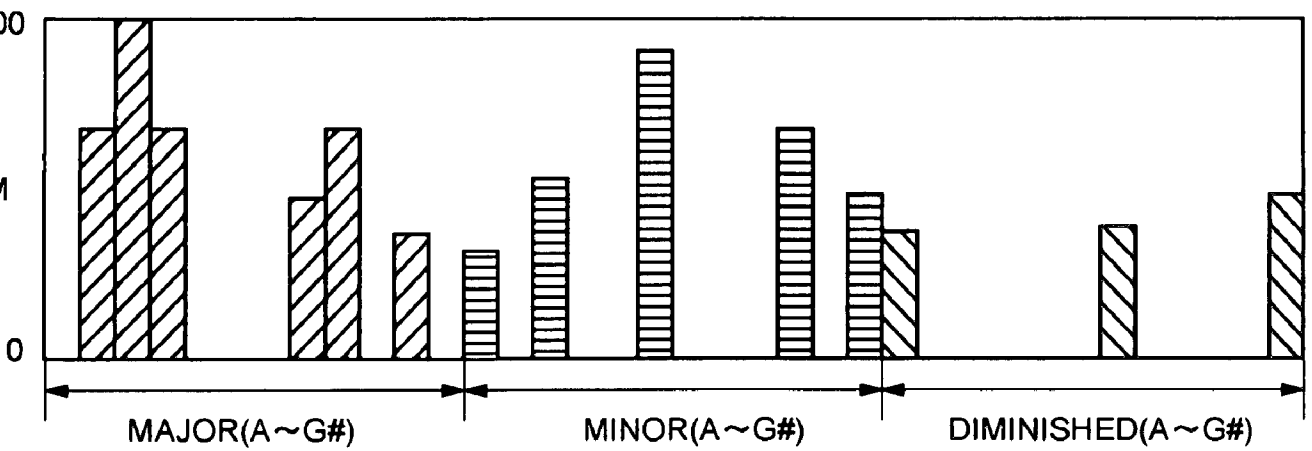

FIGS. 13A and 13B show the results of calculating the histogram values for the major (A to G#), minor (A to G#) and diminished (A to G#) chords of the chords of each musical composition. The case in FIG. 13A shows a musical composition in which chords appear over a wide range and a melody that is abundant in variations in which a variety of chords are used with very little scatter. The case in FIG. 13B shows a musical composition in which specified chords figure prominently and a small number of chords are repeated with wide scatter that has a straight melody with very little chord variation.

Following the calculation of histogram values in this manner, chord histogram deviation is calculated (step S6). When a histogram deviation is calculated, first an average value X of histogram values h(0) to h(35) is calculated by means of Equation (5).

$$X=(\Sigma h(i))/36 \quad (5)$$

In equation (5), i is between 0 and 35. That is, $$\Sigma h(i)=h(0)+h(1)+h(2)+\ldots+h(35) \quad (6)$$

The deviation σ of histogram value X is calculated by means of equation (7). i is also between 0 and 35 here.

$$\sigma=(\Sigma(h(i)-X)^2)^{1/2}/36 \quad (7)$$

The chord variation rate R is also calculated (step S7).

The chord variation rate R is calculated by means of equation (8).

$$R=M\times 60\times \Delta t/(\Sigma T(j)) \quad (8)$$

In equation (8), M is the total number of chord variations, Δt is the number of times a chord is detected over a one-second interval, and the calculation of ΣT(j) is performed for j=0 to M−1.

The musical composition identification information obtained from the music information inputting device 1, the chord progression pattern data extracted in step S4, the histogram deviation σ calculated in step S6, and the chord variation rate R calculated in step S7 are saved in the chord characteristic amount storage device 4 as chord-progression variation characteristic amounts (step S8). The format performed when the variation characteristic amount is saved is as shown in FIG. 14.

Following the execution of step S8, 1 is added to the counter value N (step S9), and it is then judged whether the counter value N has reached the musical composition quantity to be processed Q (step S10). If N<Q, the operation of steps S1 to S10 above is repeated. On the other hand, because, if N=Q, the saving of the chord-progression variation characteristic amount for the whole musical composition quantity to be processed Q has ended, the identifier ID(i) is added to the musical composition identification information of each musical composition of the musical composition quantity Q and saved (step S11).

Next, the relative chord progression frequency computation that is performed by the relative chord progression frequency processor 6 will be described. In the relative chord progression frequency computation, the frequency of a chord progression part that varies at least two times contained in the chord progression pattern data saved in the chord characteristic amount storage device 4 is computed, and a characteristic chord progression pattern group contained in a group of musical compositions to be classified is detected.

Whereas a chord progression is an absolute chord sequence, a relative chord progression is expressed as an array of frequency differences between each of the chords (root differential; 12 is added when same is negative) that constitute the chord progression and attributes of changed major and minor chords, and so forth. By using relative chord progressions, a tonality offset can be absorbed and, even when the arrangement, tempo, and so forth, are different, the melody similarity can be easily calculated.

Further, although the number of chord variations selected for the chord progression part is optional, around three is appropriate. The use of a chord progression with three variations will therefore be described.

Figure 15:
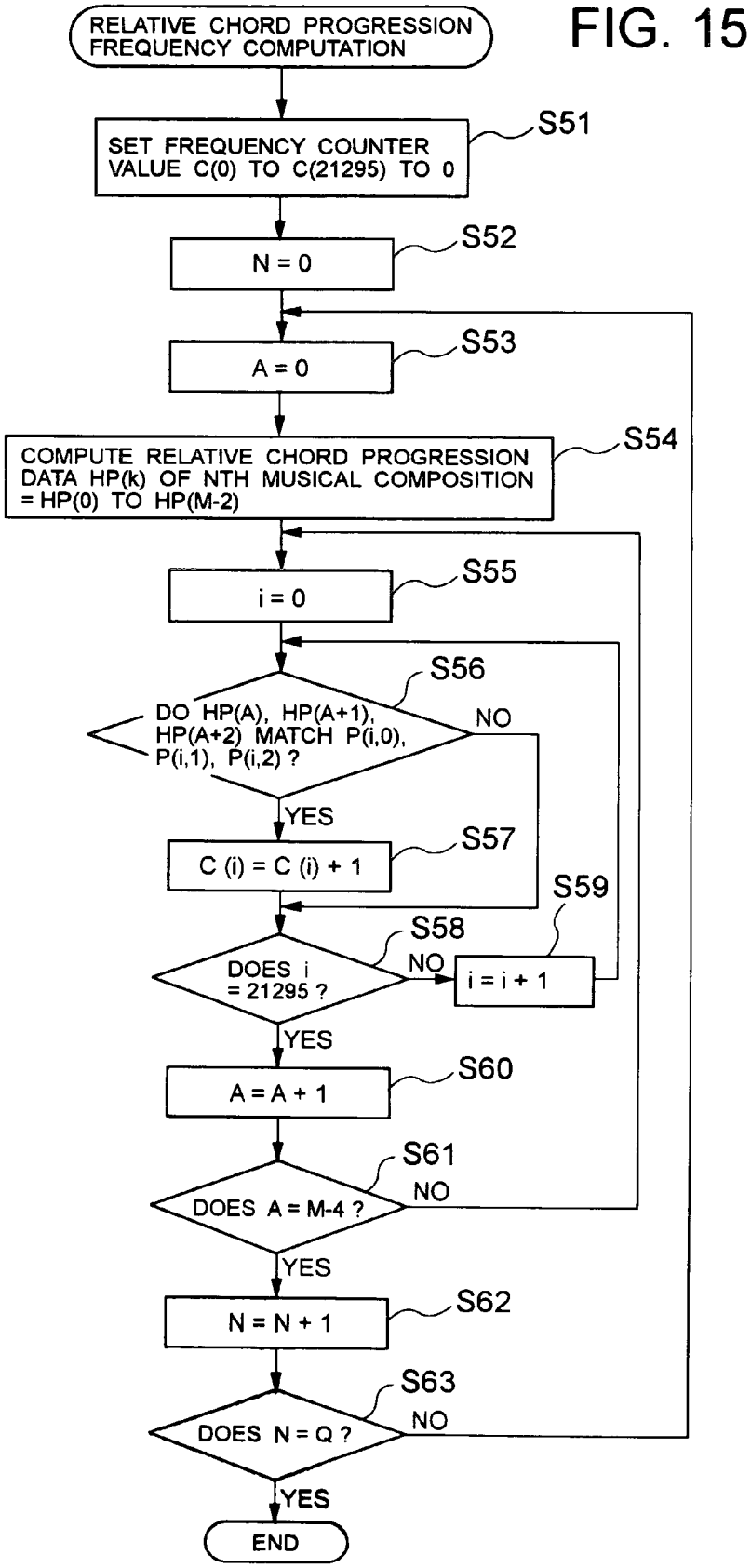
FIG. 15 is a flowchart showing relative chord progression frequency computation.

In the relative chord progression frequency computation, the frequency counter value C(i) is initially set at 0 (step S51), as shown in FIG. 15. In step S51, i=0 to 21295, and therefore settings are made such that C(0) to C(21295)=0. The counter value N is also initially set at 0 (step S52), and the counter value A is initially set at 0 (step S53).

Figure 16:
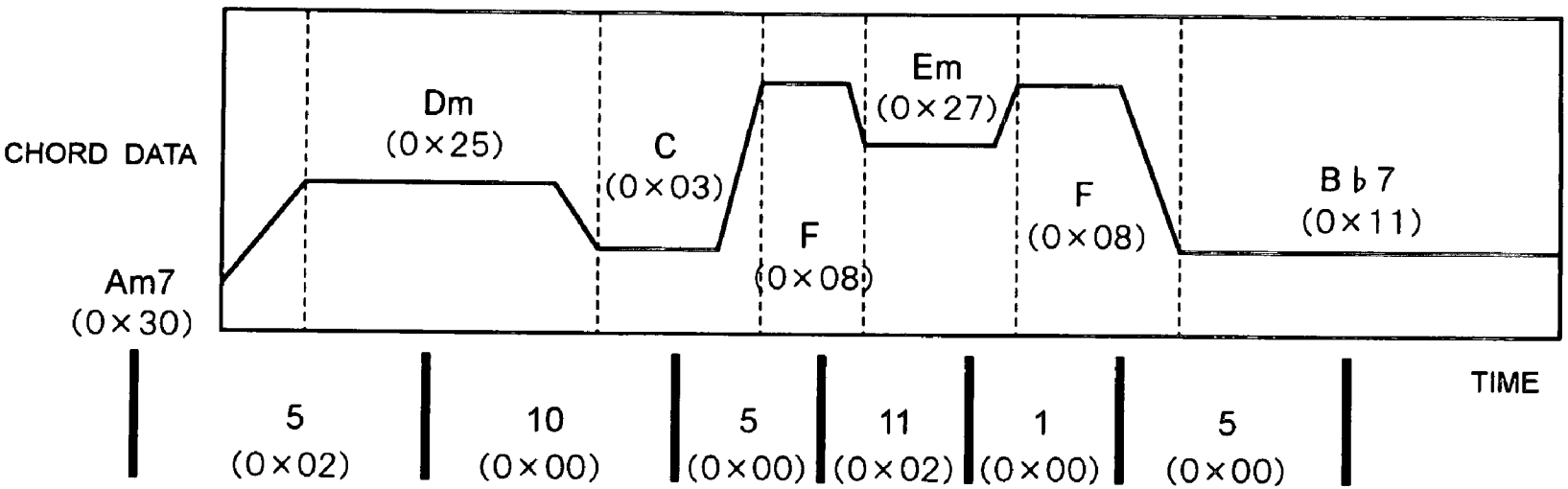
FIG. 16 shows the method of finding relative chord progression data.

The relative chord progression data HP(k) of the Nth musical composition designated by the musical composition identification information ID(N) is calculated (step S54). k of the relative chord progression data HP(k) is 0 to M−2. Relative chord progression data HP(k) is written as [frequency differential value, migration destination attribute] and is column data that represents the frequency differential value and migration destination attribute at the time of a chord variation. The frequency differential value and migration destination attribute are obtained in accordance with the chord progression pattern data of the Nth musical composition. Supposing that, when the chord variation of the chord progression pattern data as time elapses is Am7, then Dm, C, F, Em, F, and B-flat-7 as shown in FIG. 16, for example, the hexadecimal data are 0x30, 0x25, 0x03, 0x08, 0x27, 0x08, 0x11, . . . , the frequency differential values are then 5, 10, 5, 11, 1, 5, . . . , and the migration destination attributes are 0x02, 0x00, 0x00, 0x02, 0x00, 0x00, . . . . Further, when a half tone is 1 and the value of the root (fundamental tone) is more negative at the migration destination than before the migration, the frequency differential value is found by adding 12 to the migration destination such that the migration destination is more positive than before the migration. Further, the seventh and diminished are ignored as chord attributes.

Figure 17:
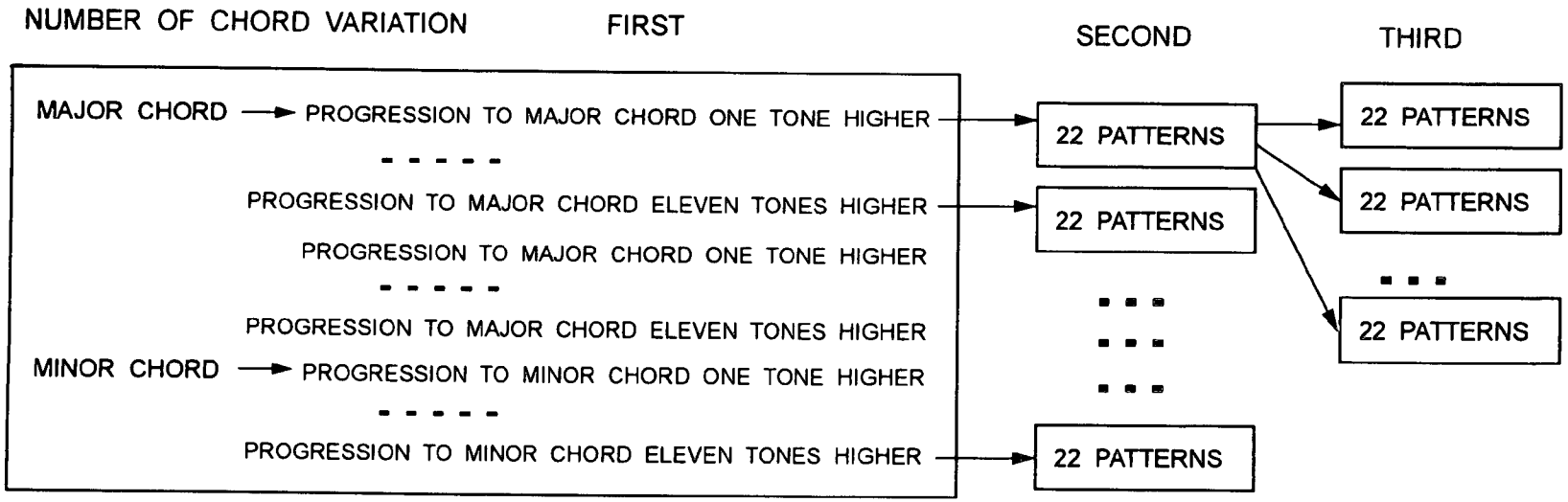
FIG. 17 shows a plurality of chord variation patterns in a case where there are three chord variations.

Following the execution of step S54, the variable i is initially set at 0 (step S55) and it is judged whether the relative chord progression data HP(A), HP(A+1), and HP(A+2) match the relative chord progression patterns P(i,0), P(i,1), and P(i,2) respectively (step S56). The relative chord progression pattern is written as [frequency differential value, migration destination attribute] as per the relative chord progression data. As the relative chord progression pattern, the chord progression is constituted by major and minor chords, meaning that, in the case of three chord variations, there are 2×22×22×22=21296 patterns. That is, as shown in FIG. 17, in the first chord variation, there are twenty-two patterns consisting of a one-tone upward major chord migration, a two-tone upward major chord migration, . . . , an eleven-tone upward major chord migration, a one-tone upward minor chord migration, a two-tone upward minor chord migration, . . . , and eleven-tone upward minor chord migration. There are also twenty-two patterns in the subsequent second and third chord variations. The relative chord progression pattern P(i,0) is the first chord variation, the pattern P(i,1) is the second chord variation, and the pattern P(i,2) is the third chord variation pattern, these patterns being provided in the memory of the relative chord progression frequency processor 6 (not shown) in the form of a data table in advance.

In a case where there is a match between HP(A), HP(A+1), HP(A+2) and P(i,0), P(i,1), and P(i,2) respectively, that is, when HP(A)=P(i,0), HP(A+1)=P(i,1), and HP(A+2)=P(i,2), 1 is added to the counter value C(i) (step S57). Thereafter, it is judged whether the variable i has reached 21296 (step S58). If i<21296, 1 is added to i (step S59), and step S56 is executed once again. If i=21296, 1 is added to the counter value A (step S60), and it is judged whether counter value A has reached M−4 (step S61). When there is no match between HP(A), HP(A+1), HP(A+2) and P(i,0), P(i,1), and P(i,2) respectively, step S57 is skipped and step S58 is executed immediately.

When the judgment result of step S61 is A<M−4, processing returns to step S55 and the above matching judgment operation is repeated. In a cases where A=M−4, 1 is added to the counter value N (step S62), and it is judged whether N has reached the musical composition quantity Q (step S63). If N<Q, processing returns to step S53 and the earlier relative chord progression frequency computation is performed on another musical composition. If N=Q, the relative chord progression frequency computation ends.

As a result of the relative chord progression frequency computation, the frequencies for chord progression parts (P(i,0), P(i,1), P(i,2):i=0 to 21295) of 21296 patterns including three variations that are contained in a musical composition group of the musical composition quantity Q are obtained as the counter values C(0) to C(21295).

The chord progression characteristic vector that is created by the chord progression characteristic vector creation part 7 is rendered by a value depending on x(n,i) and each of the musical compositions to be classified are multidimensional vectors representing measurements containing characteristic chord progression pattern groups represented by C(i), and P(i,0), P(i,1), and P(i,2). n in x(n,i) is 0 to Q−1 and indicates the number of the musical composition.

Figure 18:
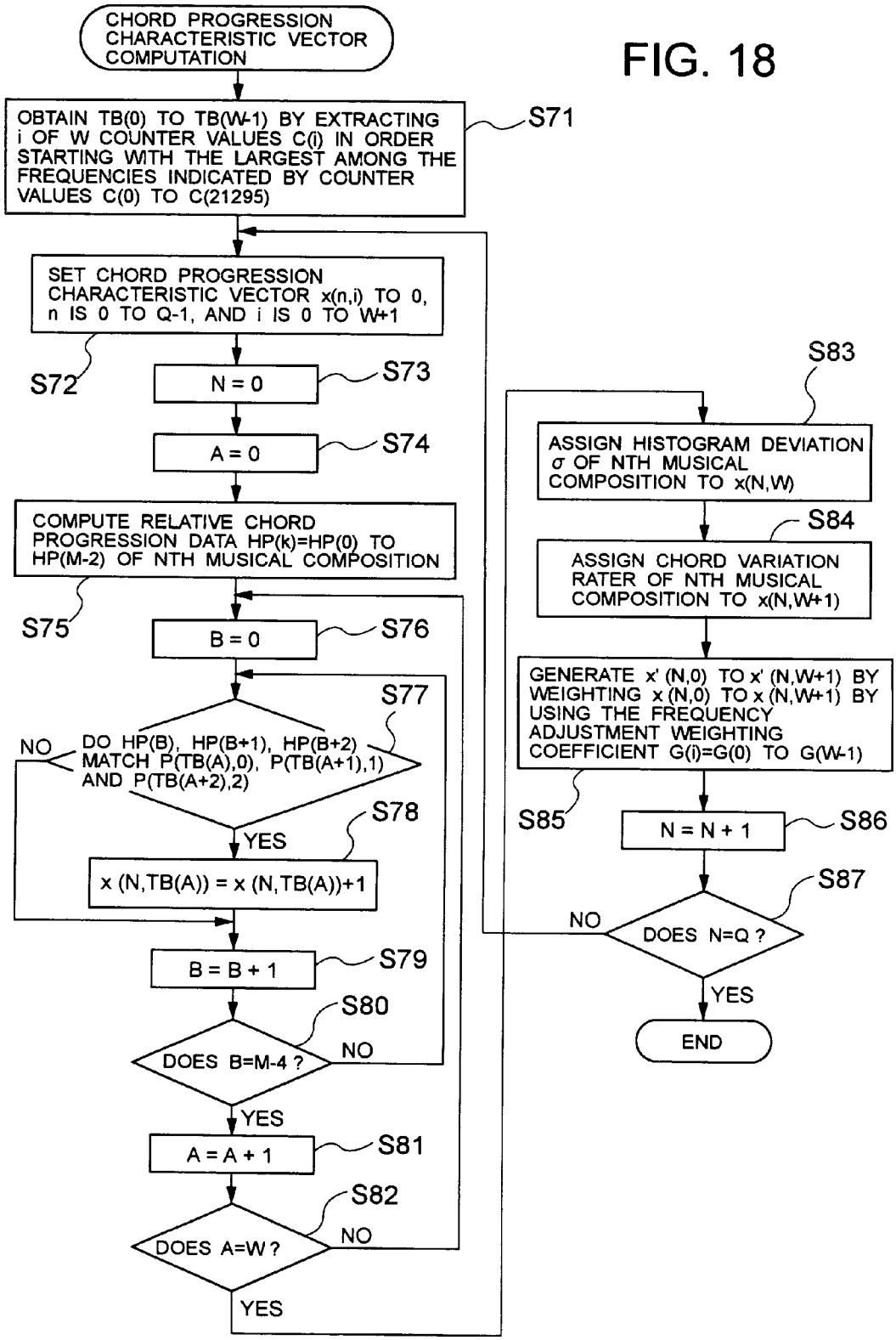
FIG. 18 is a flowchart showing chord progression characteristic vector creation processing.

As shown in FIG. 18, in the chord progression characteristic vector creation processing by the chord progression characteristic vector creation part 7, the i values of W counters C(i) are first extracted in order starting from the largest value of the frequencies indicated by the counter values C(0) to C(21295) (step S71). That is, TB(j)=TB(0) to TB(W−1), which represents the i value, is obtained. The frequency indicated by the counter value C (TB(0)) with the i value indicated by TB(0) is the maximum value. The frequency indicated by the counter value C (TB(W−1)) with the i value represented by TB(W−1) is a large value for the Wth counter value. W is 80 to 100, for example.

Following the execution of step S71, the value of the chord progression characteristic vector x(n,i) corresponding with each musical composition to be classified is cleared (step S72). Here, n is 0 to Q−1, and i is 0 to W+1. That is, x(0,0) to x(0,W+1), x(Q−1, 0) to x(Q−1,W+1), and x'(0,0) to x'(0,W+1), . . . x'(Q−1, 0) to x'(Q−1, W+1) are all 0. Further, as per the steps S52 to S54 of the relative chord progression frequency computation, counter value N is initially set at 0 (step S73), and counter value A is initially set at 0 (step S74). The relative chord progression data HP(k) of the Nth musical composition is then computed (step S75). k of the relative chord progression data HP(k) is between 0 and M−2.

Following the execution of step S75, the counter value B is initially set at 0 (step S76), and it is judged whether there is a match between the relative chord progression data HP(B), HP(B+1), HP(B+2) and the relative chord progression patterns P(TB(A),0) P(TB(A),1), and P(TB(A),2) respectively (step S77). Steps S76 and S77 are also executed as per steps S55 and S56 of the relative chord progression frequency computation.

When there is a match between HP(B), HP(B+1), HP(B+2) and P(TB(A),0) P(TB(A),1), P(TB(A),2) respectively, that is, when HP(B)=P(TB(A),0), HP(B+1)=P(TB(A),1), and HP(B+2)=P(TB(A),2), 1 is added to vector value x (N,TB(A)) (step S78). Thereafter, 1 is added to counter value B (step S79), and it is judged whether counter value B has reached M−4 (step S80). When there is no match between HP(B), HP(B+1), HP(B+2) and P(TB(A),0) P(TB(A),1), and P(TB(A),2) respectively, step S78 is skipped and step S79 is immediately executed.

In cases where the judgment result of step S80 is B<M−4, processing returns to step S77 and the matching judgment operation is repeated. When B=M−4, 1 is added to the counter value A (step S81), and it is judged whether A has reached a predetermined value W (step S82). If A<W, processing returns to step S76 and the matching judgment operation of step S77 is performed on the relative chord progression patterns with the next largest frequency. If A=W, the histogram deviation a of the Nth musical composition is assigned as the vector value x (N,W) (step S83), and the chord variation rate R of the Nth musical composition is assigned as the vector value x (N,W+1) (step S84).

Figure 19:
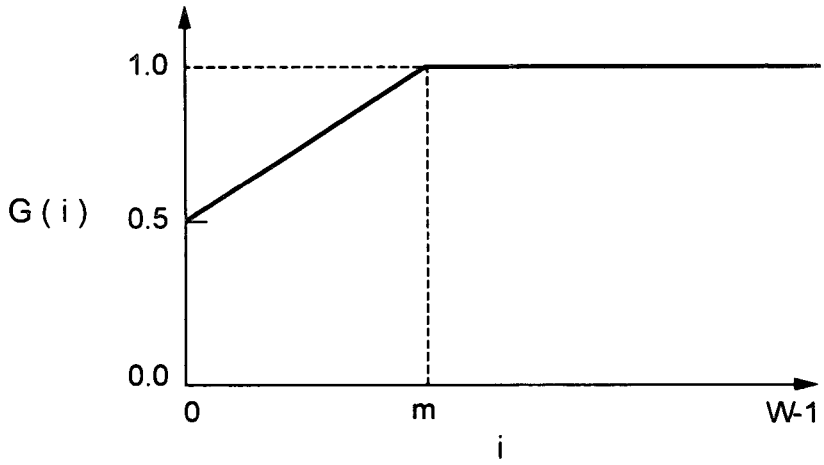
FIG. 19 shows a characteristic curve for a frequency adjustment weighting coefficient G(i)

Following the execution of step S84, the chord progression characteristic vectors x(N,0) to x(N,W+1) are weighted by using frequency adjustment weighting coefficient G(i) =G(0) to G(W−1), and the corrected chord progression characteristic vectors x'(N,0) to x'(N,W+1) are generated (step S85). Generally, music that follows the flow of Western music contains a greater amount of movement (hereinafter called 'fundamental chord progression') in which tonics, dominants, and subdominants are combined than the chord progression for identifying the music's melody which is the focus of the present invention. Frequency adjustment is performed in order to prevent dominance of the frequency of this fundamental chord progression. The frequency adjustment weighting coefficient G(i) is G(i)=(0.5/m)Þi+0.5 and is a value less than 1 for i=0 to m−1 as shown in FIG. 19 and is 1 for i=m to W−1. That is, the frequency is adjusted by executing step S85 with respect to upper m−1 patterns with an extremely high frequency. The number of patterns m regarded as fundamental chord progressions is suitably on the order of 10 to 20.

1 is added to counter value N (step S86) and it is judged whether N has reached the musical composition Q (step S87). If N<Q, processing returns to step S72 and the chord progression characteristic vector creation processing is executed for another musical composition. If N=Q, the chord progression characteristic vector creation processing ends.

Figure 20:
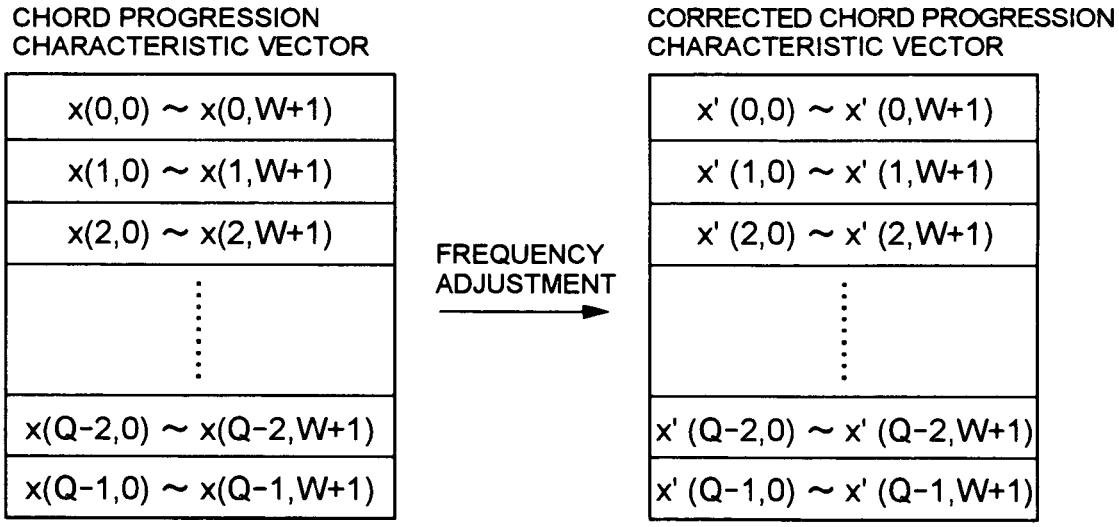
FIG. 20 shows the results of chord progression characteristic vector creation processing.

Accordingly, as shown in FIG. 20, when the chord progression characteristic vector creation processing is complete, chord progression characteristic vectors x(0,0) to x(0,W+1), Þx(Q−1,0) to x(Q−1,W+1) and x'(0,0) to x'(0, W+1), . . . x'(Q−1,0) to x'(Q−1,W+1) are created. Further, vectors x(N,W) and x(N,W+1) and x'(N,W) and x'(N,W+1) respectively are the same.

Next, the music classification processing and classification result display processing performed by the musical composition cluster creation part 8 use chord progression characteristic vector groups generated by the chord progression characteristic vector creation processing to form a cluster of vectors with a short distance therebetween. Unless the number of final classification results is fixed in advance, any clustering method may be used. For example, self-organized mapping or similar can be used. The self-organized mapping converts a multidimensional data group into a one-dimensional low-order cluster with similar characteristics. Further, self-organized mapping is effective as a method of efficiently detecting the ultimate number of classification clusters when the cluster classification method illustrated in Terashima et al. 'Teacherless clustering classification using data density histogram on self-organized characteristic map, IEEE Communications Magazine, D-II, Vol. J79-D-11, No.7, 1996' is employed. In this embodiment example, clustering is performed by using the self-organized map.

Figure 21:
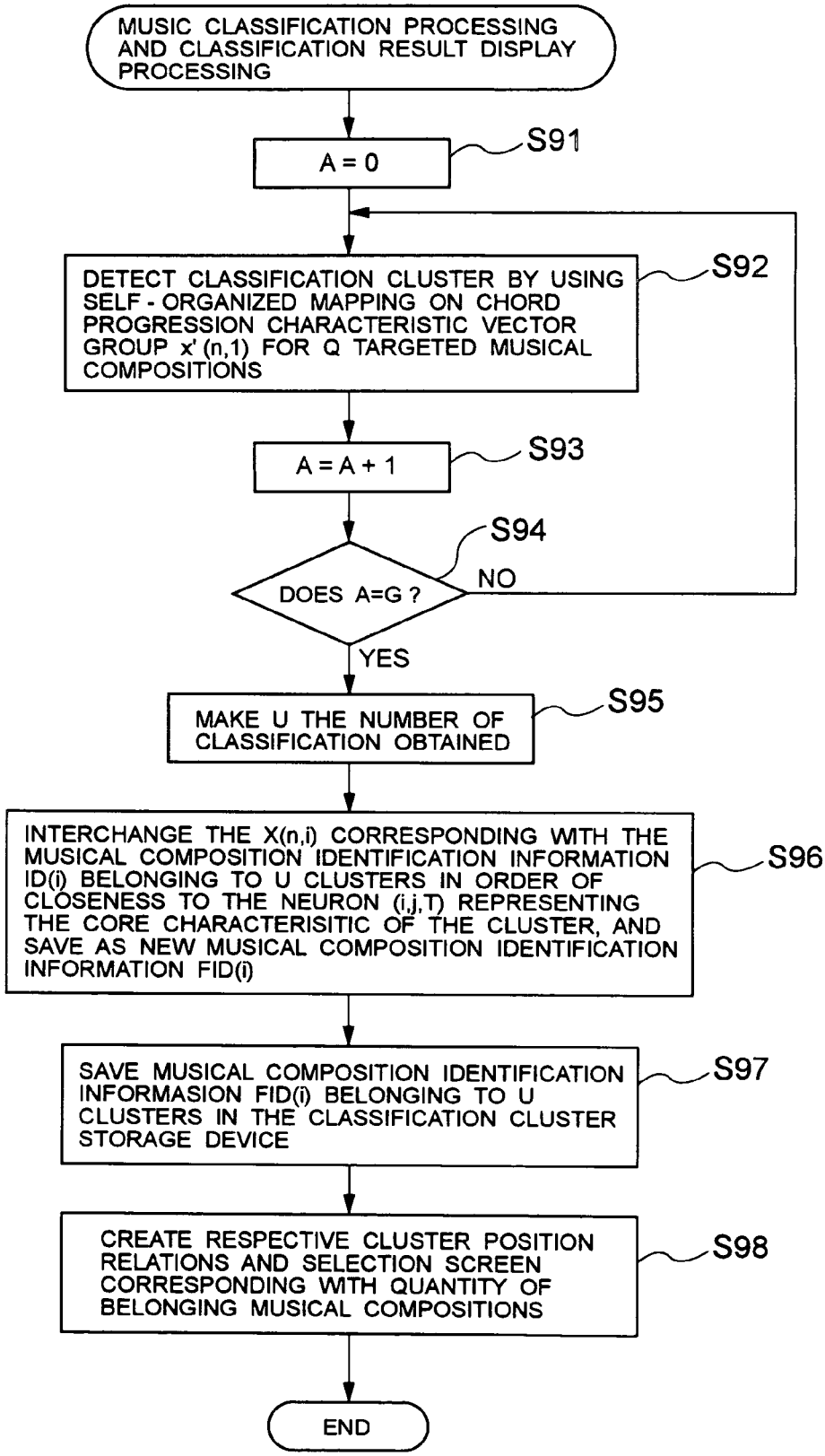
FIG. 21 is a flowchart showing music classification processing and classification result display processing.

As shown in FIG. 21, in the music classification processing and classification result display processing, counter value A is initially set at 0 (step S91) and classification clusters are detected by using self-organized mapping on chord progression characteristic vector groups x'(n,i)=x'(0,0) to x'(0,W+1), . . . x'(Q−1,0) to x'(Q−1,W+1) of Q targeted musical compositions (step S92). In self-organized mapping, K neurons m(i,j,t) with the same number of dimensions as input data x'(n,i) are initialized with random values and a neuron m(i,j,t) for which the distance of the input data x'(n,i) is the smallest among the K neurons is found, and the importance of the neurons close to (within a predetermined radius of) m(i,j,t) can be changed. That is, the neurons m(i,j,t) are rendered by means of Equation (9).

$$m(i,j,t+1)=m(i,j,t)+hc(t)[x'(n,i)-m(i,j,t)] \quad (9)$$

In equation (9), t=0 to T, n=0 to Q−1, i=0 to K−1, and j=0 to W+1. hc(t) is a time attenuation coefficient such that the size of the proximity and degree of change decreases over time. T is the number of learning times, Q is the total number of musical compositions, and K is the total number of neurons.

Following the execution of step S92, 1 is added to the counter value A (step S93), and it is judged whether counter value A, that is, the number of learning times A has reached a predetermined number of learning times G (step S94). If A<G, in step S92, the neuron m(i,j,t), for which the distance of input data x'(n,i) is smallest among the K neurons, is found, and the operation to change the importance of the neurons close to m(i,j,t) is repeated. If A=G, the number of classifications obtained as a result of the computation operation of step S92 is U (step S95).

Next, X(n,i), which corresponds with the musical composition identification information ID(i) belonging to the U clusters thus obtained, is interchanged in order of closeness to the neuron m(i,j,T) representing the core characteristic in the cluster and is saved as new musical composition identification information FID(i) (step S96). Musical composition identification information FID(i) belonging to U clusters is then saved in the classification cluster storage device 9 (step S97). In addition, respective cluster position relations and a selection screen that corresponds with the number of musical compositions belonging to the clusters, and the selection screen data is outputted to the music cluster unit display device 10 (step S98).

Figure 22:
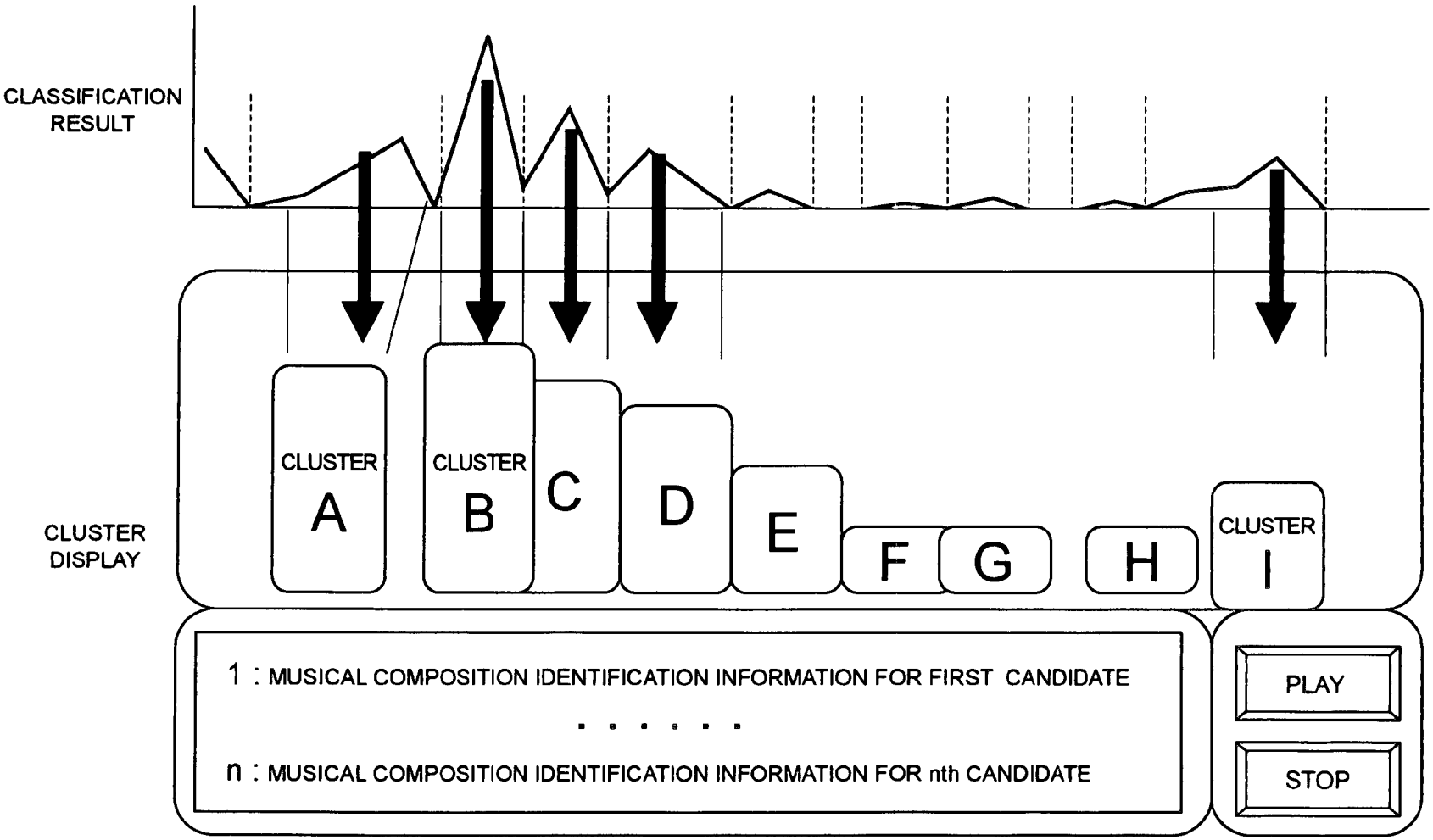
FIG. 22 shows classification results and a cluster display example.

FIG. 22 shows an example of a cluster display in which classification results of self-organized mapping are displayed by the music cluster unit display device 10. In FIG. 22, clusters A to I are rendered by one frame, wherein the height of each frame represents the volume of musical compositions belonging to each cluster. The height of each frame has no absolute meaning as long as the difference in the number of musical compositions belonging to each cluster can be identified in relative terms. Where the positional relationships of each cluster are concerned, adjoining clusters express groups of musical compositions with close melodies.

Figure 23:
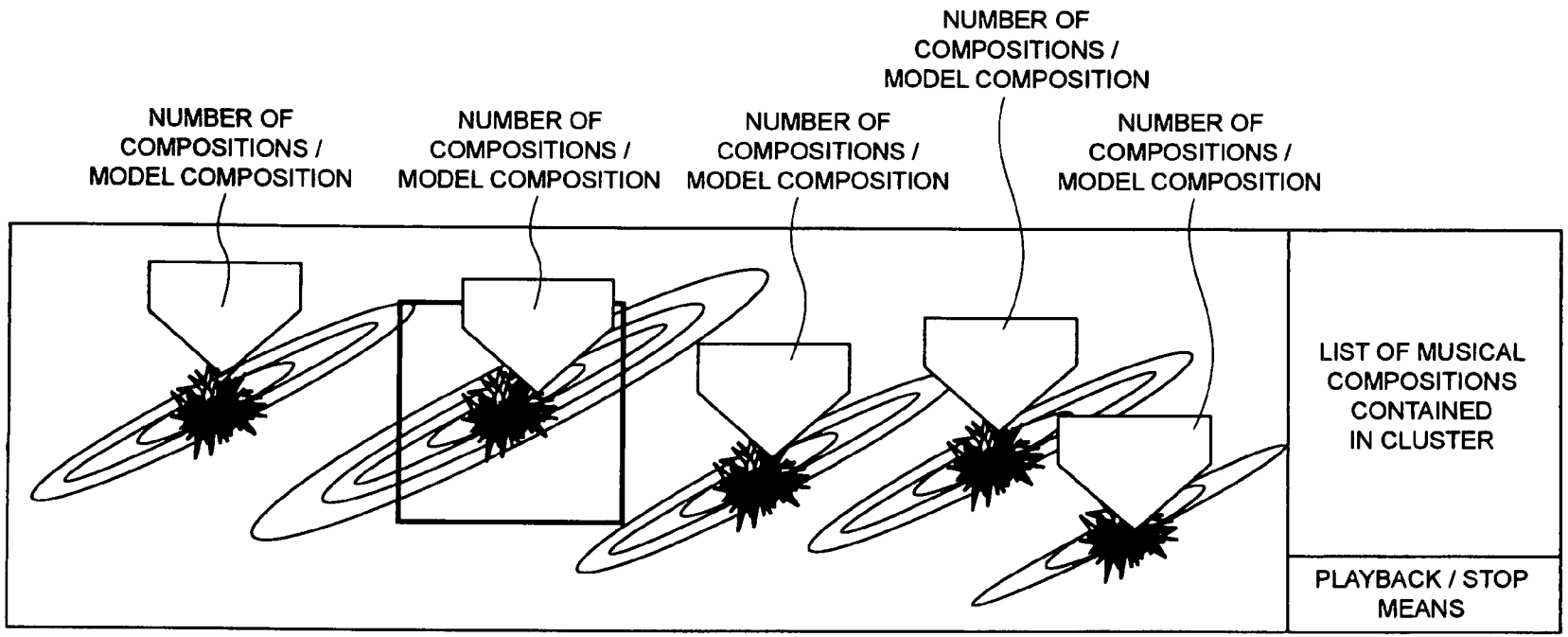
FIG. 23 shows optional cluster display images.

FIG. 23 shows an actual interface image of a cluster display. Further, although FIG. 23 shows the self-organized mapping of this embodiment example as being one-dimensional, two-dimensional self-organized mapping is also widely known.

Figure 24:
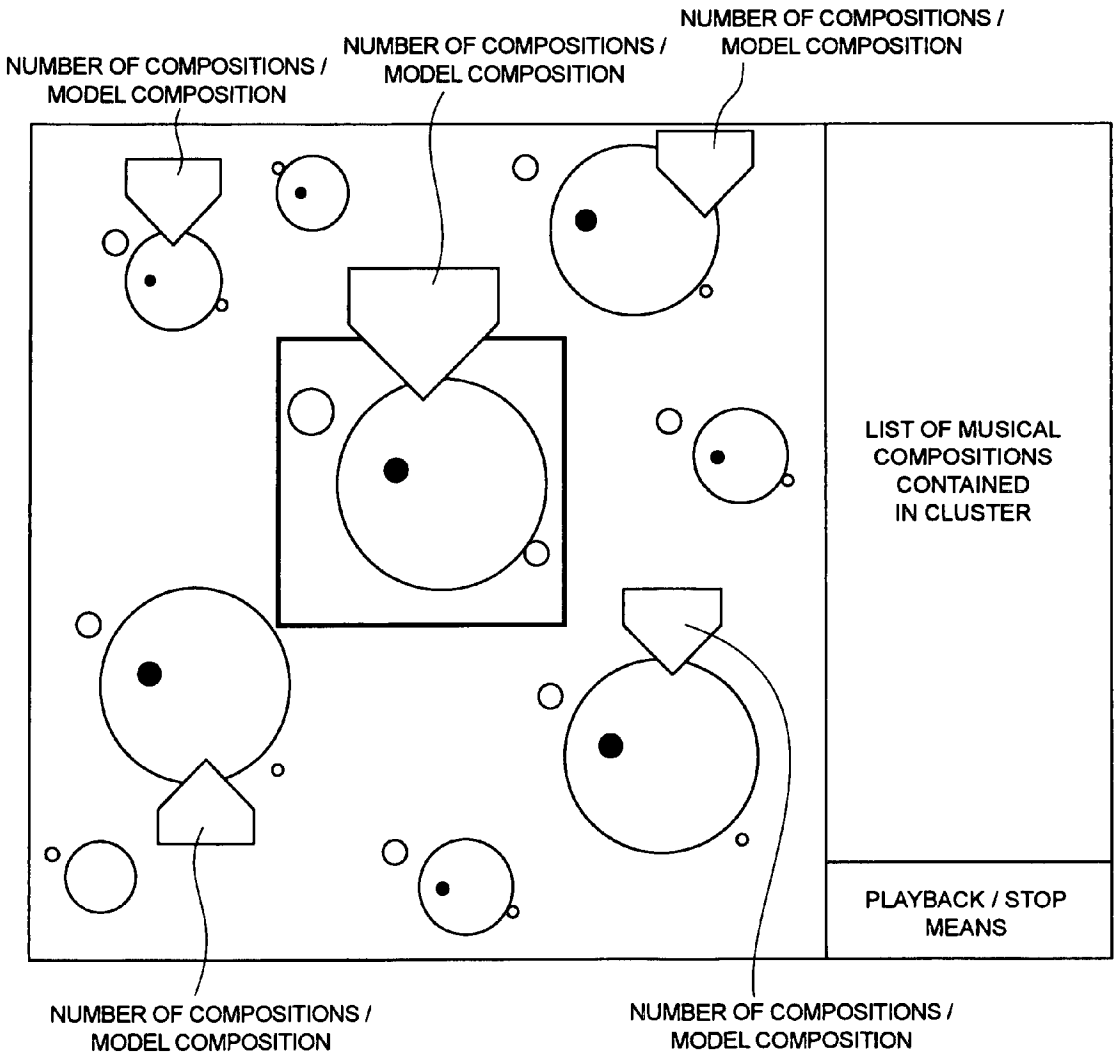
FIG. 24 shows other optional cluster display images.

In cases where the classification processing of the present invention is implemented by means of two-dimensional self-organized mapping, the use of an interface image as shown in FIG. 24 is feasible. Each galaxy in FIG. 23 represents one cluster and each planet in FIG. 24 represents one cluster. The part that has been framed is the selected cluster. Further, on the right-hand side of the display image in FIGS. 23 and 24, a musical composition list contained in the selected cluster and playback/termination means comprising operation buttons are displayed.

As a result of the respective processing above, the automatic classification processing using chord progression characteristic vectors is completed for all the musical compositions to be classified and the display that allows optional clusters to be selected is completed.

Selection and playback processing for the classified music clusters is performed by the music cluster unit display device 10 and music cluster selection device 11.

Figure 25:
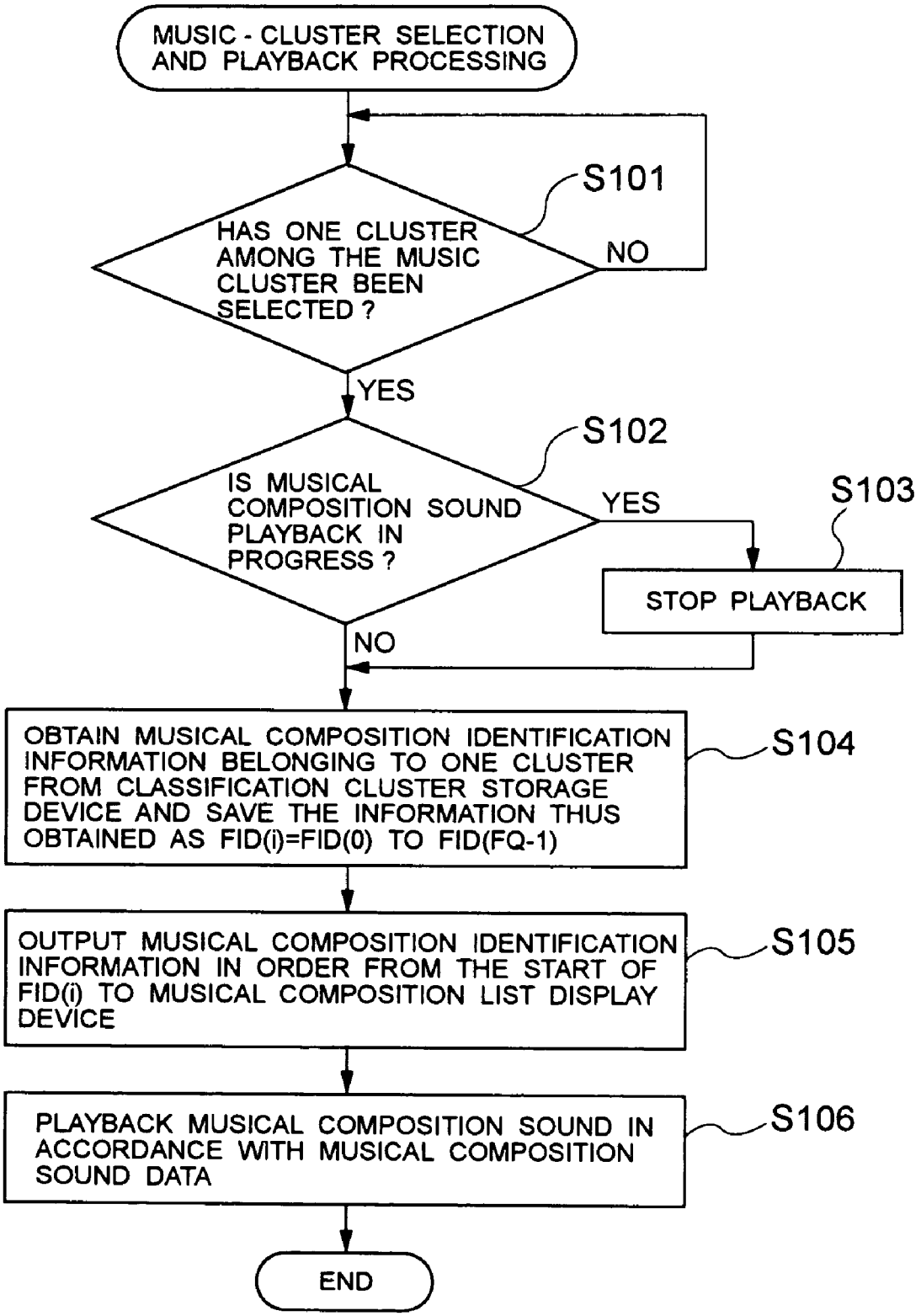
FIG. 25 is a flowchart showing music-cluster selection and playback processing.

As shown in FIG. 25, in the music-cluster selection and playback processing, it is judged whether the selection of one cluster among the classified music clusters (clusters A to I shown in FIG. 22, for example) has been performed (step S101). When the selection of one cluster has been confirmed, it is judged whether musical composition sound playback is currently in progress (step S102). When it has been confirmed that musical composition sound playback is in progress, the playback is stopped (step S103).

Figure 26:
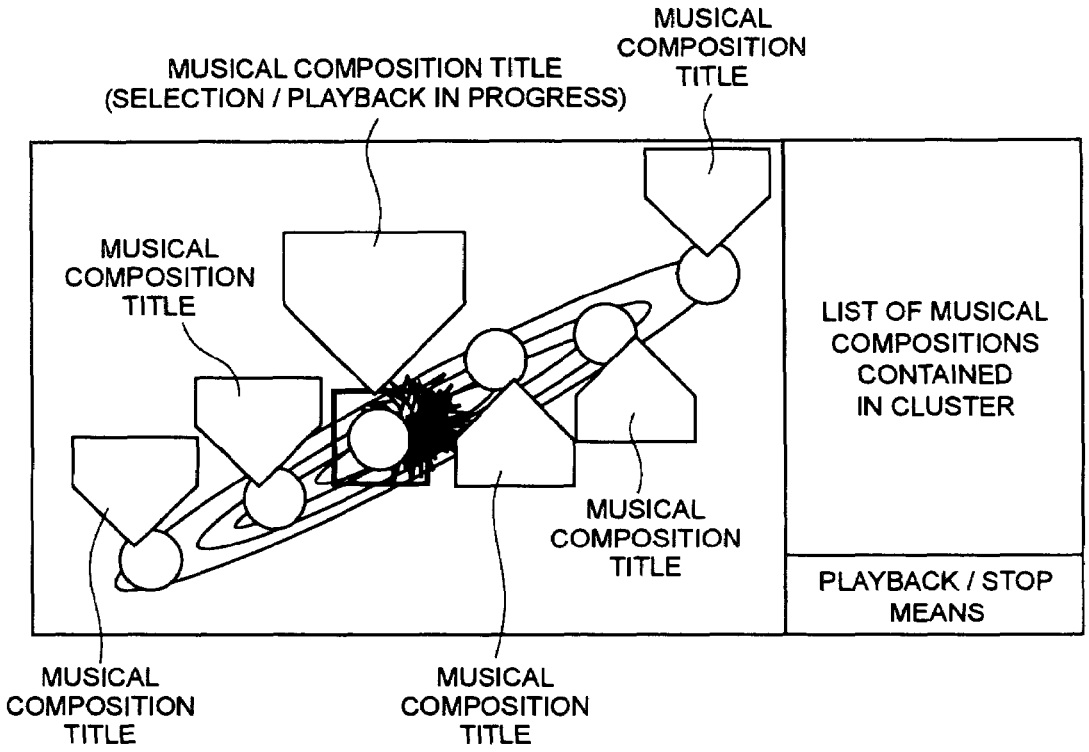
FIG. 26 shows a musical composition list display image.

In cases where musical composition sound playback is not in progress or when playback is stopped in step S103, musical composition identification information belonging to the one selected cluster is extracted from the classification cluster storage device 8 and the extracted information is then saved in FID(i)=FID(0) to FID (FQ−1) (step S104). FQ is musical composition identification information belonging to the one cluster above, that is, the musical composition quantity. Musical composition identification information is outputted to the musical composition list display device 14 in order starting from the start of the FID(i) (step S105). The musical composition list display device 14 displays the names of each of the musical compositions contained in the musical composition identification information corresponding with the one selected cluster so that these names are known by means of an interface image such as that shown in FIG. 26, for example.

The musical composition corresponding with FID(0) at the start of FID(i) is automatically selected by the model composition extraction part 12 and the musical composition sound data corresponding with FID(0) are then read out from the musical composition storage device 5 and supplied to the music playback device 16. The musical composition sound is played back in accordance with the musical composition sound data supplied by the music playback device 16 (step S106).

Further, a plurality of musical compositions is displayed on the musical composition list display device 14 in accordance with FID(i) instead of playing back the musical composition sound corresponding with FID(0). In a case where one musical composition is selected from the plurality of musical compositions via the musical composition list selection device 15, the musical composition sound data corresponding with this one musical composition are read out from the musical composition storage device 5 and then supplied to the music playback device 16. The music playback device 16 may then play back and output the musical composition sound of the one musical composition.

Figure 27:
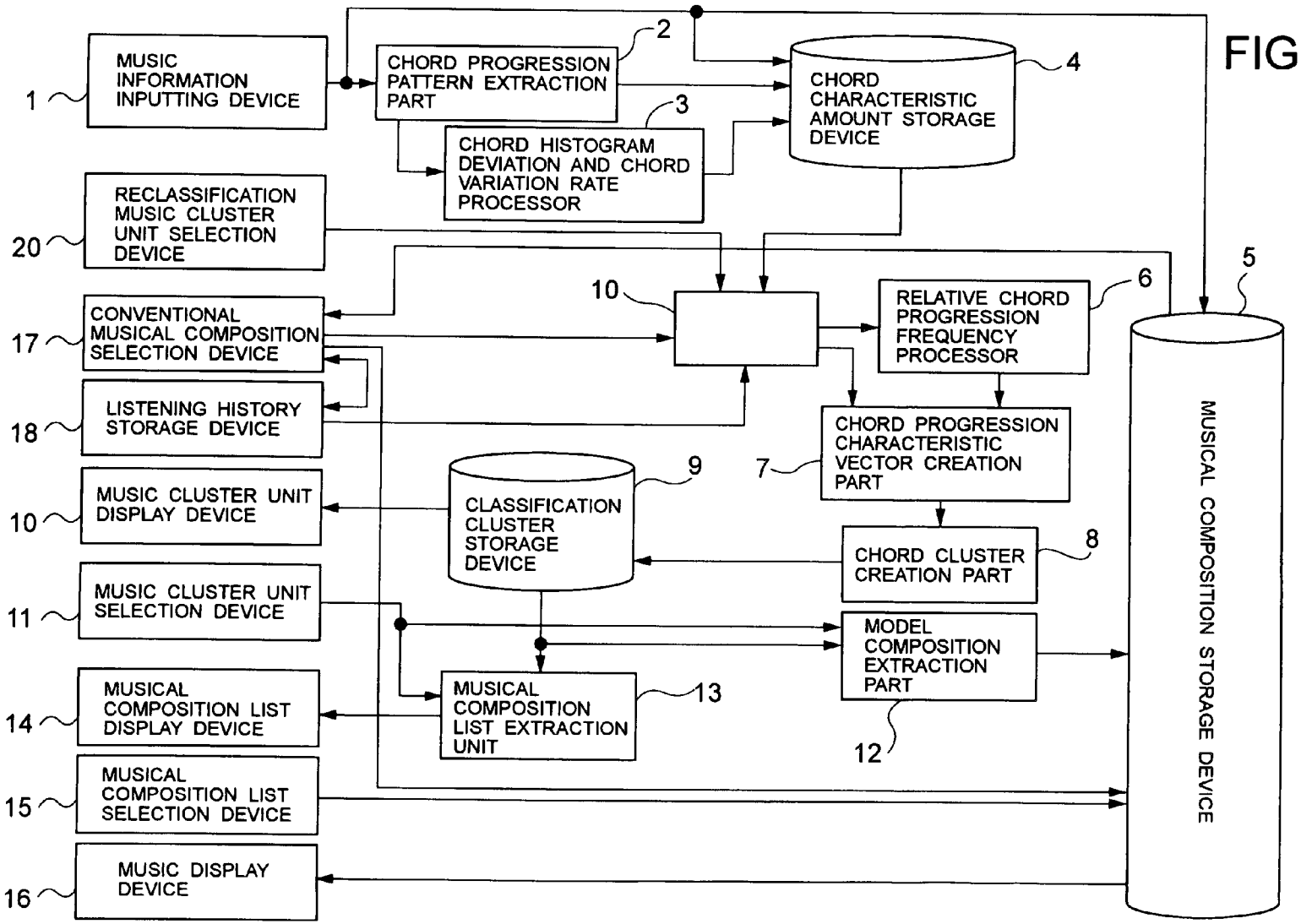
FIG. 27 is a block diagram showing another embodiment of the present invention.

FIG. 27 shows an automatic musical composition classification device of another embodiment example of the present invention. The automatic musical composition classification device in FIG. 27 comprises, in addition to the devices (parts) 1 to 16 shown in the automatic musical composition classification device in FIG. 1, a conventional musical composition selection device 17, a listening history storage device 18, a target musical composition selection part 19, and a reclassification music cluster unit selection device 20.

The automatic musical composition classification device in FIG. 27 corresponds to a case where not only are all the musical compositions that have been saved as musical composition sound data in the musical composition storage device 5 classified but classification of those musical compositions that have been limited by predetermined conditions is also performed.

The conventional musical composition selection device 17 is a typical device from the prior art for selecting musical compositions saved in the musical composition storage device 5 by using the musical composition identification information that makes it possible to specify a musical composition such as the song title, the singer's name and the genre. The musical composition thus selected is then played back by the music playback device 16.

The listening history storage device 18 is a device for storing musical composition identification information for a musical composition that has been played back one or more times by the music playback device 16.

The reclassification music cluster selection means 20 are a device for selecting the desired classification result by using the music classification results displayed by the music cluster unit display device 10.

The target musical composition selection part 19 is a device that supplies, to the relative chord progression frequency processor 6 and chord progression characteristic vector creation part 7, all the musical composition identification information saved in the musical composition storage device 5 or the chord-progression variation characteristic amounts that correspond to the musical composition identification information selected for the classification target musical composition by the conventional musical composition selection device 17 and the reclassification music cluster unit selection means 20.

Figure 28:
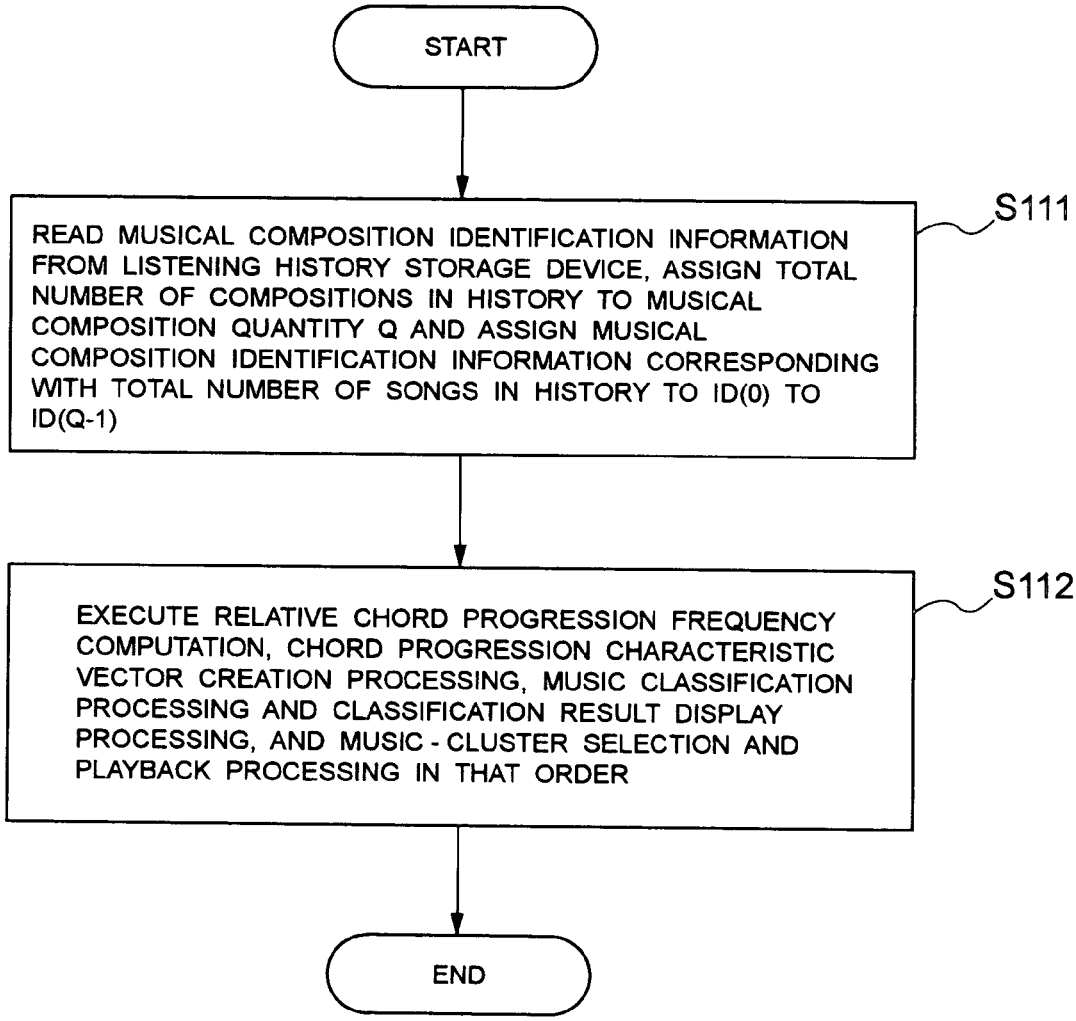
FIG. 28 is a flowchart showing an example of the operation of the device in FIG. 27.

First, in cases where only a plurality of musical compositions matched to relative preferences that the user has listened to up until that point is classified according to the melody, musical composition identification information is read from the listening history storage device 18, the total number of compositions in the history is assigned as the musical composition quantity Q, and the musical composition identification information corresponding with the total number of compositions in the history is assigned as ID(i) =ID(0) to ID(Q−1) (step S111), whereupon the above-mentioned relative chord progression frequency computation, the chord progression characteristic vector creation processing, the music classification processing and classification result display processing and the music-cluster selection and playback processing are executed in that order (step S112), as shown in FIG. 28.

Figure 29:
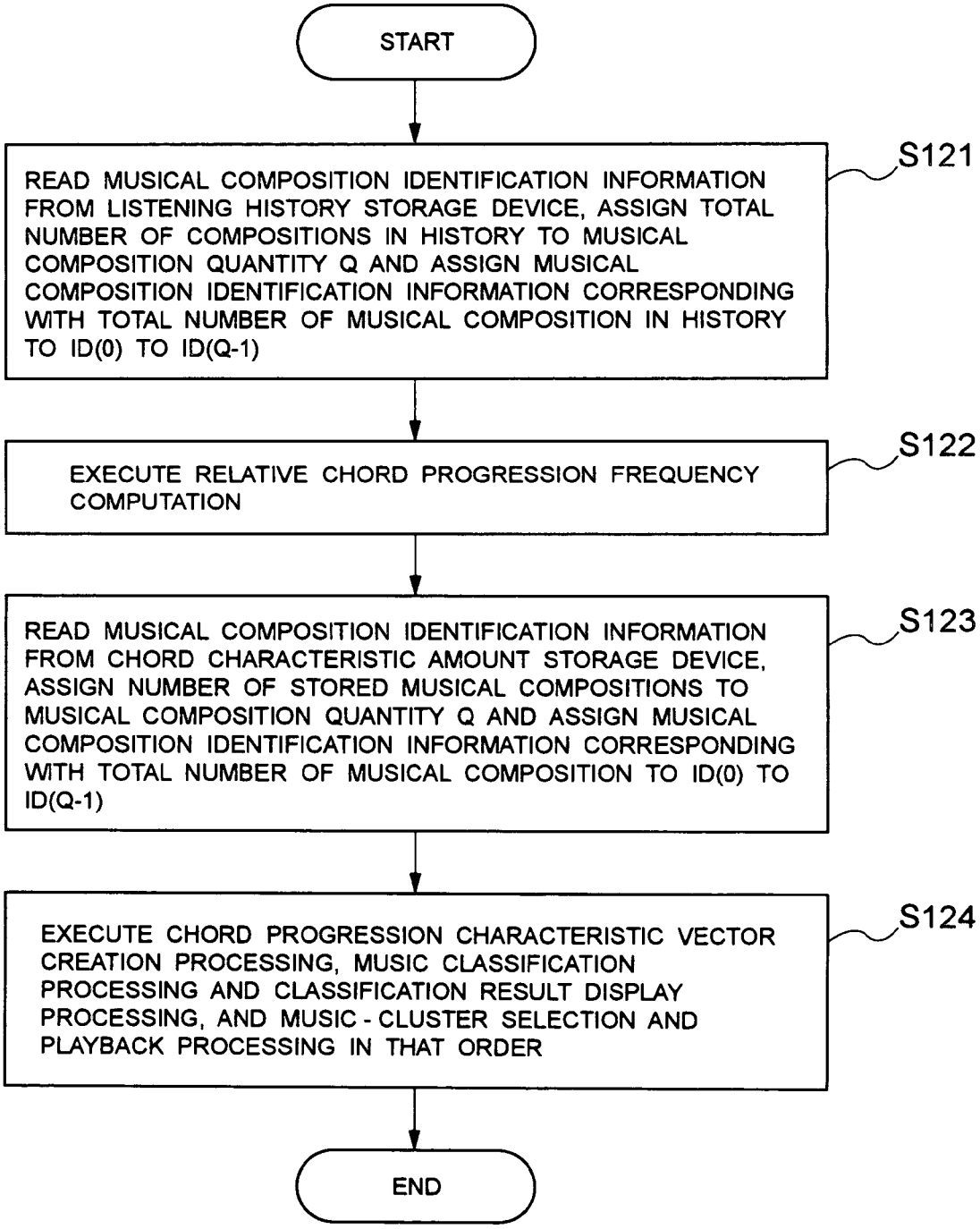
FIG. 29 is a flowchart showing another example of the operation of the device in FIG. 27.

Next, in cases where a plurality of musical compositions saved in the musical composition storage device 5 is classified according to the melody by using a plurality of musical compositions matched to relative preferences that the user has listened to up until that point, as per step S111, the musical composition identification information is read from the listening history storage device 18, the total number of compositions in the history is assigned as the musical composition quantity Q, the musical composition identification information corresponding with the total number of compositions in the history is assigned as ID(i)=ID(0) to ID(Q−1) (step S121), and the relative chord progression frequency computation is performed in accordance with the results of executing step S121 (step S122), as shown in FIG. 29. Thereafter, the musical composition identification information is read out from the chord characteristic amount storage device 4, the total number of stored musical compositions is assigned as the musical composition quantity Q, and the musical composition identification information corresponding with the total number of compositions is assigned as ID(i)=ID(0) to ID(Q−1) (step S123). The chord progression characteristic vector creation processing, the music classification processing and classification result display processing and the music-cluster selection and playback processing are executed in that order (step S124).

Figure 30:
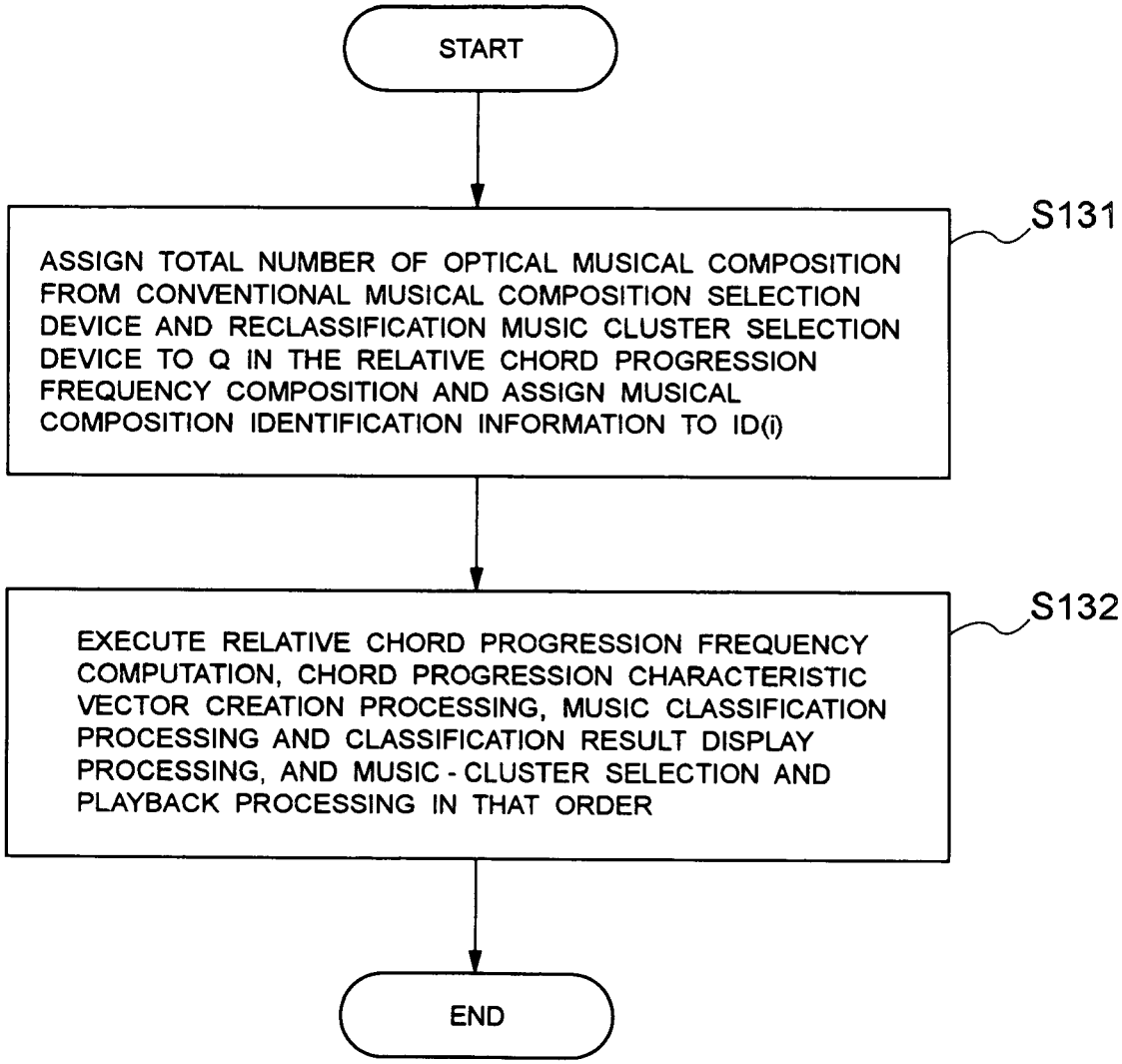
FIG. 30 is a flowchart showing another example of the operation of the device in FIG. 27.

Further, when a specified group of musical compositions or a specified group of musical compositions belonging to a designated cluster, which is selected based on the singer's name, the genre, or the like, is used, and only this group of musical compositions is classified based on the melody, the total number of optional musical compositions from the conventional musical composition selection device 17 or reclassification music cluster selection device 20 is assigned as Q of the relative chord progression frequency computation and the musical composition identification information group is assigned as ID(i) (step S131). Thereafter, relative chord progression frequency computation, chord progression characteristic vector creation processing, music classification processing and classification result display processing, and music-cluster selection and playback processing are executed in that order (step S132), as shown in FIG. 30.

Figure 31:
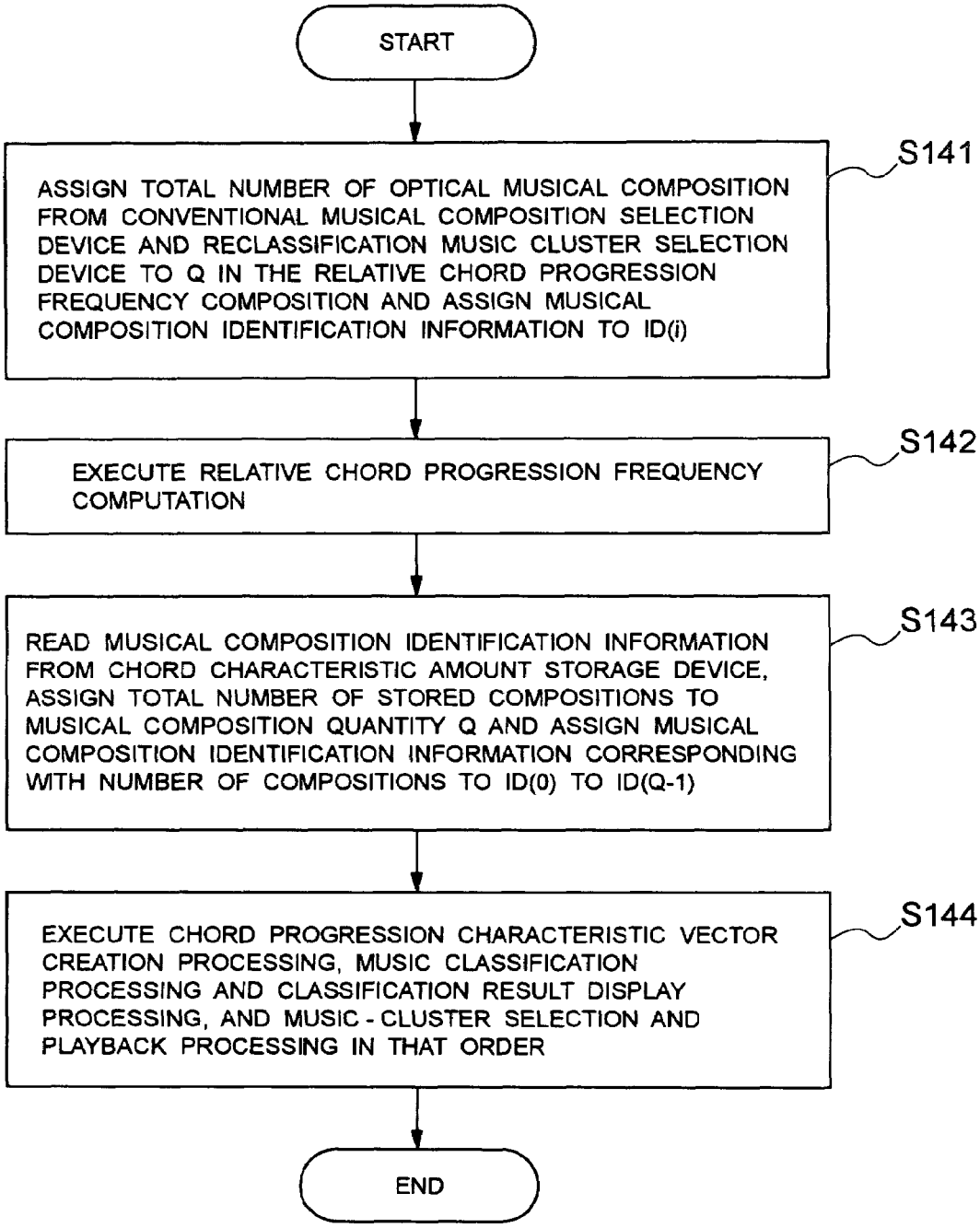
FIG. 31 is a flowchart showing another example of the operation of the device in FIG. 27.

In addition, when all the musical composition groups of the musical composition storage device 5 are classified based on the melody by using a specified plurality of musical compositions selected on the basis of the singer's name, the genre, and so forth or a specified group of musical compositions belonging to a designated cluster, the total number of optional musical compositions from the conventional musical composition selection device 17 or reclassification music cluster selection device 20 are assigned as Q of the relative chord progression frequency computation and a musical composition identification information group is assigned as ID(i) (step S141), before the relative chord progression frequency computation is executed (step S142), as shown in FIG. 31. Thereafter, the total number of items of musical composition identification information saved in the chord information amount storage device 4 is assigned as Q in the chord progression characteristic vector creation processing and the musical composition identification information group is assigned as ID(i) (step S143). Thereafter, chord progression characteristic vector creation processing, music classification processing and classification result display processing, and music-cluster selection and playback processing are executed in that order (step S144).

The present invention comprises chord progression data storage means for storing chord progression pattern data representing a chord progression sequence of a plurality of musical compositions, characteristic amount extraction means for extracting a chord-progression variation characteristic amount for each of a plurality of musical compositions in accordance with the chord progression pattern data, and cluster creation means for grouping a plurality of musical compositions in accordance with the chord progression sequence represented by the chord progression pattern data of each of the plurality of musical compositions and with chord-progression variation characteristic amounts. Therefore, as a guideline for musical composition classification, changes in the melody, that is, a chord progression, which is an important characteristic amount that expresses the so-called tonality of the music, can be used to implement automatic classification of the musical compositions. Therefore, the following effects can be implemented.

(1) Musical compositions with similar melodies can be easily selected without the inclusion of bibliographical information such as the song title or genre and without restricting a listener's image of the music by means of statically defined language such as 'uplifting', whereby it is possible to listen to music that conforms directly with sensibilities.

(2) Clusters that are displayed in adjacent positions while belonging to different clusters of musical compositions is composed of melodies that are more similar than those of other clusters. Therefore, even though a listener's image of the music differs somewhat as a result of such selection, musical compositions with similar melodies can be easily selected.

(3) Therefore, the significant characteristics of music such as movement in the melody are invoked irrespective of the existence of a melody and of a difference in the tempo and instead of all the characteristics such as the tonality and register, arrangement, or the like, whereby musical compositions of a large number of types can be classified and selected.

(4) Musical compositions can be classified according to a composer's unique style, a genre-specific melody, and melodies that are prevalent in each period. This fact can be equated to the extraction of preferences and themes when the music cannot be expressed using language and makes it possible to create new ways of enjoying the music.

(5) The present invention can also be applied to music that is limited by specified conditions and more intricate melodies can be classified for musical composition groups selected on the basis of a singer's name, the genre, or the like, and for musical composition groups that are suited to the relative preferences of habitual listening. Therefore, once musical composition groups that were not originally of interest have been excluded from the classification targets beforehand, a method of enjoying the music that satisfies individual preferences can be provided.

This application is based on Japanese Patent Application No. 2003-392292 which is herein incorporated by reference.

What is claimed is:

1. An automatic musical composition classification device that automatically classifies a plurality of musical compositions, comprising:

a chord progression data storage part that saves chord progression pattern data representing a chord progression sequence for each of the plurality of musical compositions;

a characteristic amount extraction part that extracts chord-progression variation characteristic amounts for each of the plurality of musical compositions in accordance with the chord progression pattern data; and a cluster creation part that groups the plurality of musical compositions in accordance with the chord progression sequence represented by the chord progression pattern data of each of the plurality of musical compositions and with the chord-progression variation characteristic amounts, wherein the characteristic amount extraction part comprises:

a chord histogram processor that calculates, as each of histogram values, a total of durations of each of chords that exist in the musical composition in accordance with the chord progression pattern data for each of the plurality of musical compositions;

a histogram deviation processor that calculates the histogram deviation in accordance with the histogram values of the respective chords for each of the plurality of musical compositions; and a chord variation rate processor that calculates the chord variation rate in accordance with the chord progression pattern data for each of the plurality of musical compositions; and wherein the histogram deviation and the chord variation rate of each of the plurality of musical compositions are the variation characteristic amounts.

2. The automatic musical composition classification device according to claim 1, comprising:

a cluster display part that displays a plurality of clusters that are classified by the classification part;

a selection part that selects any one of the plurality of clusters displayed by the cluster display part in accordance with an operation;

a musical composition list display part that displays a list of musical compositions belonging to the one cluster; and a playback part that selectively plays back the musical composition sound of each of the musical compositions belonging to the one cluster.

3. The automatic musical composition classification device according to claim 2, wherein the playback part comprises a musical composition storage device that stores musical composition sound data representing the sound of the plurality of musical compositions.

4. The automatic musical composition classification device according to claim 2, wherein the playback part plays back the sound of a model musical composition among the musical compositions belonging to the one cluster.

5. The automatic musical composition classification device according to claim 1, wherein the chord progression data storage part saves the chord progression pattern data in association with the musical composition identification information for identifying each of the plurality of musical compositions.

6. An automatic musical composition classification device that automatically classifies a plurality of musical compositions, comprising:

a chord progression data storage part that saves chord progression pattern data representing a chord progression sequence for each of the plurality of musical compositions;

a characteristic amount extraction part that extracts chord-progression variation characteristic amounts for each of the plurality of musical compositions in accordance with the chord progression pattern data; and a cluster creation part that groups the plurality of musical compositions in accordance with the chord progression sequence represented by the chord progression pattern data of each of the plurality of musical compositions and with the chord-progression variation characteristic amounts, wherein the cluster creation part comprises:

a relative chord progression frequency processor that detects chord progression parts of a predetermined number of types in a descending order of frequency of appearance from among all of at least two consecutive chord progression parts contained in a chord progression sequence that is represented by the chord progression pattern data of all the predetermined musical compositions;

a chord progression characteristic vector processor that detects the frequency of appearance of each of the chord variation parts of the predetermined number of types in the chord progression sequence represented by the chord progression pattern data for each of the plurality of musical compositions and saves the detected frequency and said chord-progression variation characteristic amounts as chord progression characteristic vector values; and a classification part that classifies the plurality of musical compositions into clusters having similar melodies by performing self-organization processing for the chord progression characteristic vector values of each of the plurality of musical compositions.

7. The automatic musical composition classification device according to claim 6, wherein the relative chord progression frequency processor comprises:

a relative chord progression data generation part that generates relative chord progression data representing a differential value of the root before and after a change of chord and the types of the changed chord for all the chords in a musical composition in accordance with the chord progression pattern data of each of the plurality of musical compositions;

a reference relative chord progression data generation part that generates reference relative chord progression data representing all of the chord variations patterns obtained from the at least two consecutive chord progression parts; and a comparison part that detects a match between all of the at least two consecutive chord progression parts in the relative chord progression data generated by the relative chord progression data generation part, and the reference relative chord progression data representing all of the chord variation patterns and counts the frequency of appearance of all of the at least two consecutive chord progression parts.

8. The automatic musical composition classification device according to claim 6, wherein the chord progression characteristic vector processor comprises:

a relative chord progression data generation part that generates relative chord progression data that represents a differential value of the root before and after a change of chord and the type of the changed chord in accordance with the chord progression pattern data of each of the plurality of musical compositions;

a reference relative chord progression data generation part that generates the reference relative chord progression data representing each of the chord variation parts of the predetermined number of types; and a comparison part that detects a match between all of the at least two consecutive chord progression parts in the relative chord progression data generated by the relative chord progression data generation part and the reference relative chord progression data representing each of the chord variation parts of the predetermined number of types and that counts the frequency of appearance of each of the chord variation parts of the predetermined number of types for each of the plurality of musical compositions.

9. The automatic musical composition classification device according to claim 8, wherein the chord progression characteristic vector processor further comprises:

a weighting part that calculates the ultimate frequency of each of the plurality of musical compositions by multiplying the frequency of each of the plurality of musical compositions of each of the chord variation parts of the predetermined number of types obtained by the comparison part by a weighting coefficient.

10. The automatic musical composition classification device according to claim 6, wherein the predetermined musical composition is the plurality of musical compositions.

11. The automatic musical composition classification device according to claim 6, wherein the predetermined musical composition is a musical composition with a listening history.

12. The automatic musical composition classification device according to claim 6, wherein the predetermined musical composition is a musical composition that is selected in accordance with an operation.

13. An automatic musical composition classification device that automatically classifies a plurality of musical compositions, comprising:

a chord progression data creation part that has an audio input signal representing each of the plurality of musical compositions inputted thereto and creates chord progression pattern data representing a chord progression sequence;

a chord progression data storage part that saves the chord progression pattern data for each of the plurality of musical compositions;

a characteristic amount extraction part that extracts chord-progression variation characteristic amounts for each of the plurality of musical compositions in accordance with the chord progression pattern data; and a cluster creation part that groups the plurality of musical compositions in accordance with the chord progression sequence represented by the chord progression pattern data of each of the plurality of musical compositions and with the chord-progression variation characteristic amounts of each of the plurality of musical compositions, wherein the chord progression data creation part comprises:

a frequency conversion part that converts an audio input signal representing each of the plurality of musical compositions to a frequency signal that represents the size of the frequency component at predetermined intervals;

a component extraction part that extracts, at the predetermined intervals, a frequency component that corresponds with each tone of an equally-tempered scale from the frequency signal obtained by the frequency conversion part;

a chord candidate detection part that detects, as first and second chord candidates, two chords that are each formed by a set of three frequency components with a large level total among the frequency components corresponding with each tone extracted by the component extraction part; and a smoothing part that generates the chord progression pattern data by smoothing a row of respective first and second chord candidates repeatedly detected by the chord candidate detection part.

14. An automatic musical composition classification method that automatically classifies a plurality of musical compositions, comprising the steps of:

receiving an audio input signal representing each of the plurality of musical compositions and creating chord progression pattern data representing a chord progression sequence;

storing the chord progression pattern data for each of the plurality of musical compositions;

extracting a chord-progression variation characteristic amount for each of the plurality of musical compositions in accordance with the chord progression pattern data; and grouping the plurality of musical compositions in accordance with the chord progression sequence represented by the chord progression pattern data of each of the plurality of musical compositions and with the chord-progression variation characteristic amounts of each of the plurality of musical compositions, wherein said step of receiving and creating comprises the steps of:

frequency converting an audio input signal representing each of the plurality of musical compositions to a frequency signal that represents the size of the frequency component at predetermined intervals;

extracting, at the predetermined intervals, a frequency component that corresponds with each tone of an equally-tempered scale from the frequency signal obtained by the frequency converting step;

detecting, as first and second chord candidates, two chords that are each formed by a set of three frequency components with a large level total among the frequency components corresponding with each tone extracted by the extracting step; and generating the chord progression pattern data by smoothing a row of respective first and second chord candidates repeatedly detected by the detecting step.

15. A computer-readable program that executes an automatic musical composition classification method that automatically classifies a plurality of musical compositions, comprising:

a receiving and creating step of receiving an audio input signal representing each of the plurality of musical compositions and creating chord progression pattern data representing a chord progression sequence;

a chord progression data storage step of storing the chord progression pattern data for each of the plurality of musical compositions;

a characteristic amount extraction step of extracting a chord-progression variation characteristic amount for each of the plurality of musical compositions in accordance with the chord progression pattern data; and a cluster creation step of grouping the plurality of musical compositions in accordance with the chord progression sequence represented by the chord progression pattern data for each of the plurality of musical compositions and with the chord-progression variation characteristic amounts of each of the plurality of musical compositions, wherein said receiving and creating step comprises the steps of:

frequency converting an audio input signal representing each of the plurality of musical compositions to a frequency signal that represents the size of the frequency component at predetermined intervals;

extracting, at the predetermined intervals, a frequency component that corresponds with each tone of an equally-tempered scale from the frequency signal obtained by the frequency converting step;

detecting, as first and second chord candidates, two chords that are each formed by a set of three frequency components with a large level total among the frequency components corresponding with each tone extracted by the extracting step; and generating the chord progression pattern data by smoothing a row of respective first and second chord candidates repeatedly detected by the detecting step.

* * * * *